US005293927A

United States Patent [19]

Anzai et al.

[11] Patent Number: 5,293,927

[45] Date of Patent: Mar. 15, 1994

[54] METHOD AND APPARATUS FOR MAKING STRIPS, BARS AND WIRE RODS

[75] Inventors: Einao Anzai; Hirobumi Maede; Ryuji Watanabe; Masami Wajima, all of Muroran, Japan

[73] Assignee: Nippon Steel Corporation, Tokyo, Japan

[21] Appl. No.: 654,673

[22] Filed: Feb. 14, 1991

[30] Foreign Application Priority Data

Feb. 15, 1990 [JP] Japan ..... 2-32387

[51] Int. Cl.[5] ..... B22D 11/10; B22D 11/128

[52] U.S. Cl. ..... 164/484; 164/482

[58] Field of Search ..... 164/462, 463, 482, 429, 164/432, 433, 420

[56] References Cited

U.S. PATENT DOCUMENTS

| | | | |
|---|---|---|---|
| 3,284,859 | 11/1966 | Westfield et al. | 164/429 |
| 3,478,810 | 11/1969 | Carton | 164/482 |
| 3,536,126 | 10/1970 | Lenaeus | 164/433 |
| 3,603,378 | 9/1971 | Yearly | 164/482 |
| 3,818,972 | 6/1974 | Berry | 164/482 |
| 3,881,542 | 5/1975 | Polk | 164/463 |
| 4,149,583 | 4/1979 | Tsuchida | 164/420 |

FOREIGN PATENT DOCUMENTS

| | | | |
|---|---|---|---|
| 56-68569 | 6/1981 | Japan | 164/479 |
| 57-152352 | 9/1982 | Japan | 164/479 |
| 63-13785 | 3/1988 | Japan . | |

*Primary Examiner*—Kurt C. Rowan
*Assistant Examiner*—Rex E. Pelto
*Attorney, Agent, or Firm*—Wenderoth, Lind & Ponack

[57] ABSTRACT

A method of manufacturing strips, bars and wire rods comprises continuously supplying molten metal into an open-top endless casting groove on an annular mold that is rotated around a vertical shaft, cooling the molten metal in the casting groove from outside by forcibly cooling the annular mold, and continuously taking out the cast section from the casting groove at a point where a solidified shell has been formed throughout the entire circumference of the molten metal in the casting groove. A roll is provided upstream of the take-out point to depress the top surface of the cast section, thereby keeping the cast section in close contact with the surface of the casting groove. The cast section then slides diagonally upward over a surface inclined at an angle of 5 to 60 degrees that is provided on the exit side of the above roll in the casting groove. The annular mold may also have two or more concentrically disposed casting grooves to permit multi-strand casting of molten metal poured into the individual casting grooves. A multiple of sections thus simultaneously cast are then simultaneously rolled into finished products.

16 Claims, 12 Drawing Sheets

METHOD AND APPARATUS FOR MAKING STRIPS, BARS AND WIRE RODS

BACKGROUND OF THE INVENTION

1. Field of the Invention

This invention relates to a method and apparatus for making strips, bars and wire rods of small cross-sectional areas, and more particularly to a method and apparatus for continuously casting sections of steel and other metals using an annular mold having an endless open-top casting groove and then rolling the cast sections into strips, bars and wire rods of small cross-sectional areas.

2. Description of the Prior Art

Sections having small cross-sectional areas can be continuously cast by use of a horizontal rotary groove mold.

This horizontal continuous casting method is suited for casting sections having small cross-sectional areas whose thickness is in the range of approximately 10 mm to 100 mm, not requiring heavy equipment investment while assuring high productivity. Typical examples of this method are disclosed in U.S. Pat. Nos. 3,284,859 and 3,478,810 and Japanese Patent Publication No. 13785 of 1988. The continuous caster disclosed in U.S. Pat. No. 3,284,859 has an annular mold having a trough or casting groove. The annular mold turns around a vertical shaft, and molten metal is poured from the tundish into the casting groove. To cool the molten metal in the mold, a forced cooling unit comprising spray nozzles disposed substantially at right angles to the mold wall is provided. The solidified section is continuously withdrawn from the casting groove at a point 200 to 270 degrees apart from the pouring point and delivered to the subsequent continuous rolling mill. Because of the open-top groove-shaped mold, the section cast by this method is forcibly cooled on three sides but not on the top. Thus cooled less than the other three sides, the top of the section being cast solidifies more slowly. The section cast by this method solidifies in this characteristic way. Therefore, the cast section must not be taken out of the mold until a solidified shell has been formed on the top thereof.

To take the cast section out of the horizontal rotary annular mold, the cast section must be straightened at least once. The cast section to be taken out of the annular mold must be lifted by some means. If left in the lifted position, however, the cast section will move diagonally upward beyond the straightener. Therefore, the cast section should preferably be vertically straightened again to make the pass line thereof horizontal. This is because the as-cast section does not have adequate mechanical properties and, therefore, needs a further rolling. Then, a horizontal pass line facilitates such subsequent rolling and delivery of the cast section to the heating furnace and other facilities therefor.

Lifted out of the mold, however, the section cast by this type of apparatus needs a combined application of horizontal and vertical straightening that can result in three-dimensional complicated torsional deformation. Because bending and torsion are the main stresses acting on the cast section, maximum stress works on the surface of the cast section, and, as a result of which, cracks tend to occur at the surface. Though varying somewhat with chemical composition and other factors, the embrittling temperature of carbon steels being cast is said to be normally in the range of 700° to 1200° C. This high-temperature embrittlement is said to be caused by the embrittlement of grain boundaries due to the phase transformation of steel and the precipitation of carbides, nitrides, sulfides, etc. It is therefore desirable to keep the surface temperature of the cast section out of the 700° to 1200° C. range during straightening. Actually, however, straightening in the continuous casting process with an annular mold having an endless open-top casting groove is normally performed in the temperature range of 700° to 1200° C. In an experiment conducted by the inventors, the temperature at the sides, bottom and their corners of the section being cast readily was dropped to approximately 700° C. before straightening was applied while waiting until the top surface of the cast solidified in the mold. It was difficult to keep their temperature above 1200° C. This embrittlement can be easily and effectively avoided by cooling the cast section to below 700° C. But this method is undesirable because reheating for the subsequent rolling pushes up production costs. As such, it should be considered as a last resort to be employed when no other solution can be found.

To prevent cracking in the above embrittlement temperature range, it is essential to minimize straightening strain (or straightening stress). With the straightening of the section cast through an annular mold having an endless open-top casting groove, however, no definite conditions for the prevention of cracking have been disclosed. Therefore, it seems that maximum benefits can be derived from the continuous casting method being discussed when such conditions are established. They do not seem to have been very important so long as the method has been used mainly in the continuous casting of aluminum, copper and other nonferrous metals having very high deformabilities. But commercially applicable straightening conditions must be established for carbon steel and other similar materials whose ductility not only is relatively low but also changes radically with the casting temperature.

Furthermore, conventional continuous casting with an annular mold having an endless open-top casting groove has been of the single strand type. Meanwhile, a combination of continuous casting and subsequent direct rolling utilizing the sensible heat of the cast section is known to enhance productivity while lowering production cost. Enhancement of productivity and lowering of production cost can be achieved by increasing either the casting speed or the cross-sectional area of the cast section. In increasing the casting speed, however, the machine length, which, in turn, is limited by the completion time of solidification, must be considered. Therefore, faster casting calls for a larger caster. Casting sections of larger cross-sectional areas also necessitate a larger caster. But larger casters, which are more expensive than smaller ones, neither provide the benefit of low equipment cost, which is one of the main advantages of the method being discussed, nor permit savings production in costs. As such, an effective way to cast sections of smaller cross-sectional areas with a smaller caster is a multi-strand casting method in which a number of small sections are cast at a time.

In continuous casting apparatus, an annular mold having an endless open-top casting groove is rotated within a horizontal plane. Therefore, a dam to prevent the backward flow of molten metal (hereinafter called the tail dam) is provided upstream of the pouring point and a dummy bar or a member to prevent the outflow of molten metal (hereinafter called the front dam) is provided downstream thereof. Normally, therefore, casting is started by pouring molten metal into an initial pouring space formed by the tail dam and the front end of the dummy bar or the front dam, with the rotation of the mold being started when the poured molten metal in the space reaches the desired level. The height of the section to be cast is determined by the level of the molten metal and can be adjusted by varying the balance between the pouring and withdrawing rates. Of course, casting can be carried out without thoroughly filling said initial pouring space with molten metal. But such practice is not recommended as it would cause significant size variations in cast sections which, in turn, might lower the production yield and induce various rolling troubles.

When the casting method being discussed is carried out in a multi-strand fashion, more serious problems will come up. Because the concentrically disposed the casting grooves are rotated at the same speed (angular speed), casting speed must be differentiated with regard to the inner and outer strands. Therefore, production rate varies with strands when the sections are cast to the same cross-sectional area. When multi-strand casting is combined with direct rolling, an additional coordination between the two processes becomes necessary. Moving together with the mold, the dummy bar or front dam determines the shape of the leading end of the cast section. Connected to a stationary member isolated from the rotary mold, on the other hand, the tail dam remains in its original position until casting is complete. Therefore, the height of the section to be cast is determined by the level of the molten metal and can be adjusted by varying the balance between the pouring and withdrawing rates, as mentioned before. In multi-strand casting, the molten metal in the individual strands must reach the same or desired level at the same time because the individual molds are rotated by same drive mechanism. But it is practically impossible to make the pouring rates of all strands completely equal because the size of the initial pouring space in each strand is not necessarily the same and molten metal does not always flow in the same manner. Therefore some measure must be taken at the start of the casting. When completing casting, the rotation of the mold must be stopped to permit the shaping of the tail end (hereinafter called the top portion) of the cast section. After being thus suspended, the rotation of the mold is resumed when the top portion of the cast section has solidified (this solidifying process is called top processing). As the cast section is not taken out during the top processing, the temperature of the section being cast in the mold drops so much that casting and rolling utilizing the sensible heat of the section and the resulting energy saving are difficult to achieve. When carbon steel or an other similar type of steel is cast, the temperature of the cast section held in the mold for top processing falls into the aforementioned high-temperature embrittlement range, whereby cracks tend to occur in the cast section in the subsequent straightening process. As such, top processing must be completed without causing the undesirable stagnation of the cast section in the mold. Furthermore, the advent of appropriate outflow preventing member and dummy bar, suited for use in horizontal multi-strand continuous casting with an annular mold having endless open-top casting grooves and in other types of casting operations, has long been awaited.

SUMMARY OF THE INVENTION

With a view to preventing the occurrence of cracks in the cast section being straightened, the inventors performed detailed experiments using iron-based materials, with emphasis placed on carbon steels. Studies were also made to expand the applicability of continuous casting, which has conventionally been limited to the production of bars and rods, to strips and plates.

The object of this invention is to provide concrete methods and apparatus to prevent the occurrence of cracks in the cast section induced by straightening, which are detrimental to the quality thereof, thereby making it possible to make the most of the two important advantages, i.e., low equipment cost and high productivity, of a process of continuously casting sections of small cross-sectional areas using an annular mold having endless open-top casting grooves rotated around a vertical shaft.

In order to achieve the above object, a method of manufacturing strips, bars and rods according to this invention comprises the steps of continuously supplying molten metal to the endless open-top casting grooves in an annular mold rotated around a vertical shaft, cooling the molten metal in each casting groove from the outside by forcibly cooling each annular mold, and continuously taking out the cast section from the casting groove at a point where a solidified shell has been formed at least throughout the entire circumference of the molten metal in the casting grooves. With its top side held by a cast section drive roll disposed just downstream of the take-out point, the cast section which has still not fully solidified is kept in close contact with the surface of the mold defining the bottom of the casting groove. The cast section then slides diagonally upward over a surface inclined at an angle of 5 to 60 degrees, thus leaving the casting groove.

When rolling is applied to the cast section, it is preferable to make the cast section thicker on the inner side than on the outer side by using an annular mold whose casting groove has a radially varying cross-sectional profile. The cast section taken out of the annular mold is compacted vertically by means of one or more rolling means that apply a greater compaction on the inner side of the cast section than on the outer side. This permits reducing the strains induced by straightening, thereby preventing the occurrence of cracking in the embrittlement temperature range of the cast section. Simultaneous supply of molten metal to the concentrically disposed casting grooves in an annular mold enhances productivity. Multiple cast sections can be rolled at a time following the simultaneous multi-strand continuous casting.

An apparatus for continuously casting strips, bars and wire rods according to this invention comprises an annular mold having endless open-top casting grooves rotatably held on a vertical shaft, means for rotating the annular mold, means for continuously supplying molten metal into the casting grooves, means for forcibly cooling the annular mold in such a manner as to cool the molten metal in the casting groove from the outside, a cast section drive roll disposed at a point where a solidified shell is formed at least throughout the entire circumference of the molten metal in each casting groove to depress the top side of the cast section to keep it in close contact with the surface of the mold defining the bottom of the casting groove, and means for separating the cast section from the mold disposed near the exit end of the cast section drive roll and comprising a wedge with a tapered surface inclined at an angle of 5 to 60 degrees.

In the above continuous casting apparatus, the surface defining the bottom of the casting groove may be inclined toward the inside of the annular mold so that the section being cast in the casting groove has a greater thickness on the inner side than on the outer side. When rolling is done subsequently to continuous casting, means for rolling multiple cast sections is installed on the exit side of the continuous casting apparatus. Means for heating the cast section to a rolling temperature and/or maintaining the cast section at a high temperature during the casting and rolling processes may be provided, too.

The means for starting the continuous casting comprises a tail dam provided upstream of the pouring point in the casting groove and a front dam provided downstream thereof. The casting groove, tail dam and front dam define an initial pouring space. While a controlled amount of molten metal is poured into the initial pouring space so that the level of the molten metal in the casting groove becomes high enough to permit casting a section of the desired height, the rotation of the annular mold is started.

This invention discloses a concrete straightening method and apparatus that permits the improvement of segregation, the improvement of center porosity by compensating for solidification shrinkage, and the prevention of cracking that are essential for the attainment of good-quality plates, strips, bars and rods. This invention also discloses a way to achieve these improvements by applying a light rolling to the cast section prior to straightening. Therefore, this invention permits substantial production cost savings by taking advantage of continuous casting with an annular mold featuring low equipment costs. This invention also permits direct rolling of sections prepared by multi-strand continuous casting. Now that the variations in the pouring and casting speeds between the individual strands are eliminated, smooth multi-strand continuous casting is now possible. The stable casting of molten metal and the smooth rolling of obtained cast sections assure much better product yield and productivity than before.

DETAILED DESCRIPTION OF THE PREFERRED EMBODIMENTS

Continuous Caster with a Rotary Annular Mold

Figure 1:
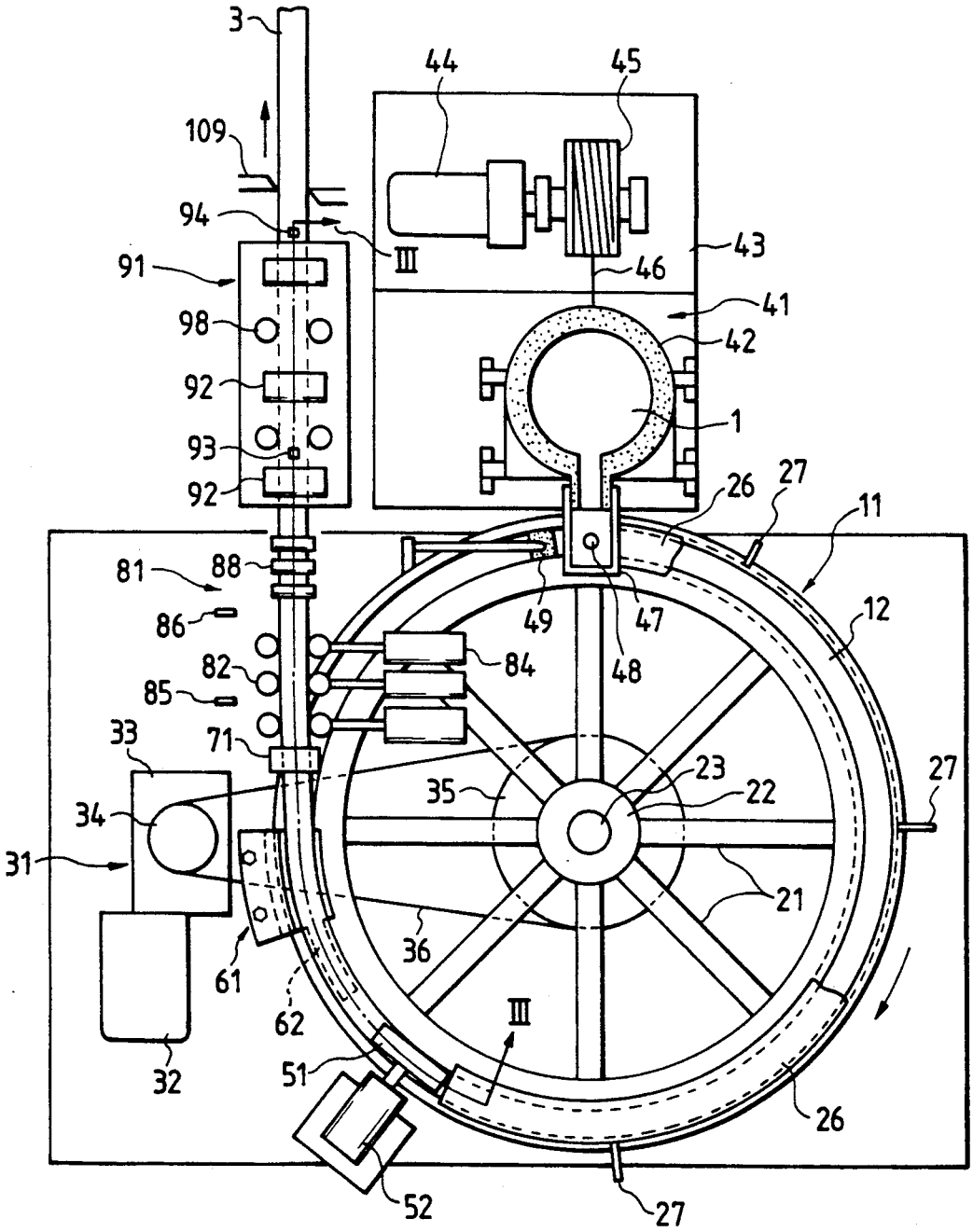
FIG. 1 is a plan view of a continuous casting apparatus with an annular mold and a straightener according to this invention.
Figure 2:
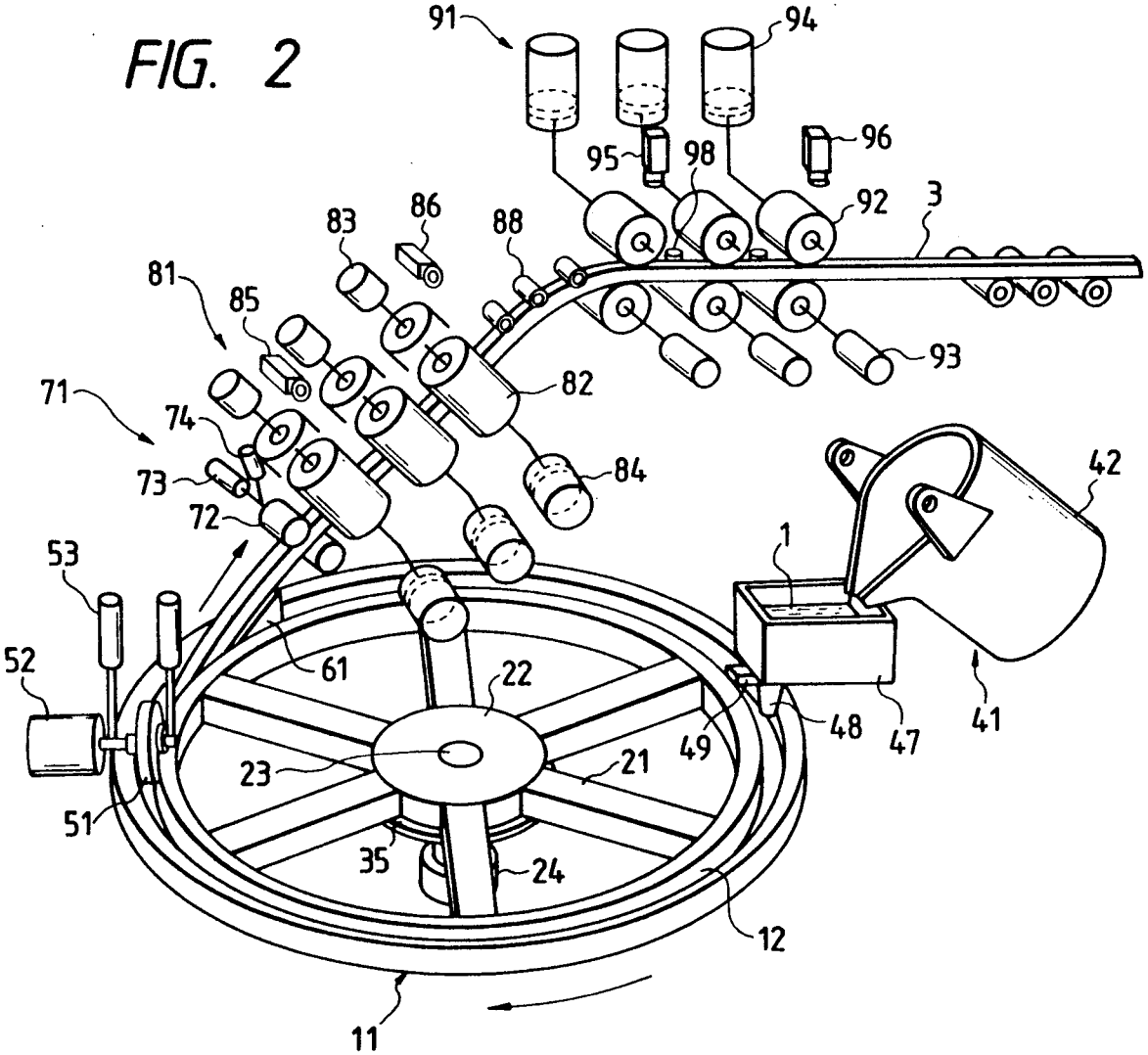
FIG. 2 is a perspective view of the apparatus shown in FIG. 1.

As shown in FIGS. 1 and 2, an annular mold 11 having an endless casting groove 12 substantially quadrangular in cross section is connected to a hub 22 through spokes 21. To the hub 22 is fastened a vertical shaft 23 that is rotatably supported by a bearing 24. The annular mold 11 is encased in a cover 26 extending substantially halfway there around from the point at which molten metal is poured. Pipes 27 to supply inert gas, such as argon and nitrogen gases, are connected to several points on the cover 26. Both sides and the bottom of the annular mold 11 are forcibly cooled with water applied from spray nozzles 29 (see FIG. 10).

A rotary mold drive unit 31 is provided on the outside of the annular mold 11. The rotary mold drive unit 31 comprises an electric motor 32 and a drive sprocket 34 connected thereto through a speed reducer 33. The drive sprocket 34 is connected to a driven sprocket 35 below the hub 22 through a chain 36. The electric motor 32 rotates the annular mold 11 at a predetermined speed.

A molten metal feeder 41 is disposed on the outside of the annular mold 11, and a ladle 42 is tiltably supported on a frame 43. A geared electric motor 44 and a drum 45 driven thereby are provided behind the ladle 42. The leading end of a wire 46 wound around the drum 45 is attached to the ladle. A tundish 47 is provided directly above the annular mold 11. The electric motor 44 turns the drum 45 to take up the wire 46 and thereby tilts the ladle 42, whereupon molten metal 1 is supplied to the tundish 47. The molten metal 1 is poured into a casting groove 12 through a pouring nozzle 48 provided in the tundish 47. A tail dam 49 is slidably inserted in the casting groove 12 at a point just upstream of the pouring point of the molten metal 1 (opposite to the rotating direction of the annular mold 11). The tail dam prevents the molten metal 1 from flowing in a direction opposite to the rotating direction of the annular mold 11.

A cast section drive roll 51 is disposed near the front end of the cover 26. The cast section drive roll 51 is attached to the output shaft of a geared motor 52 and pressed against the top surface of the section being cast by means of a press-down mechanism 53 including a compression spring. As an ordinary parallel roll can be used as the cast section drive roll, its barrel profile need not be limited to any specific design. But the roll barrel diameter may vary in the direction of the roll axis by taking the form of tapered, or curved cylinder or a spherical body. These roll barrel profiles are desirable as they can completely eliminate the occurrence of a speed difference between the drive roll and the section being cast on the inside and outside of the section, thereby entirely eliminating the risk of the section being scratched by the drive roll. The cast section drive roll thrusts forward the section being cast. By adjusting the force of the drive roll applied to the top surface of the section, a formation of internal shrinkage cavities and a concentration of solute elements in the forming and solidification processes can be reduced. Thus, the cast section drive roll can perform two functions of thrusting forward and pressing down the section being cast. The press-down mechanism mentioned before may be a hydraulic cylinder or jack, too.

Figure 3:
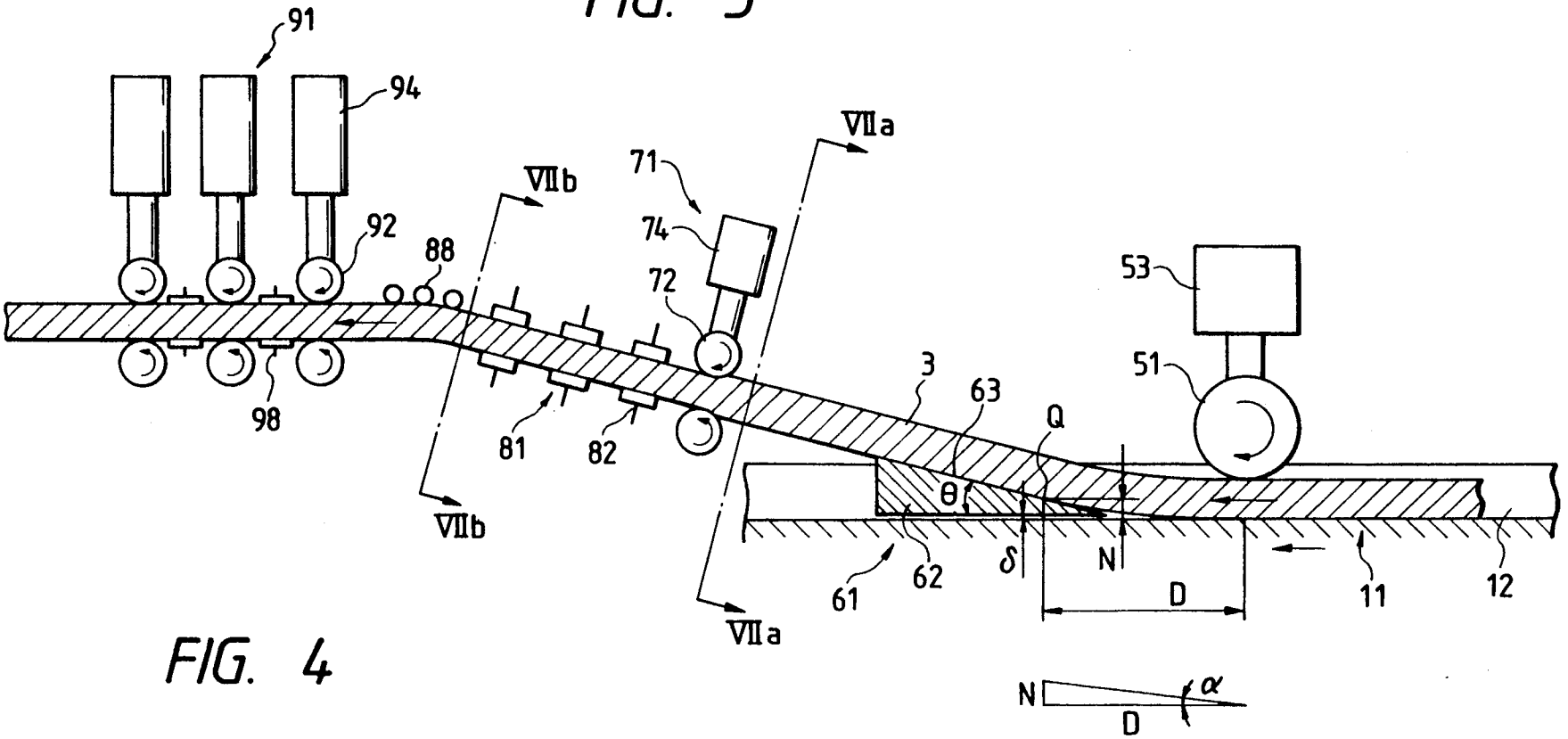
FIG. 3 is a cross-sectional view taken along the line III—III of FIG. 1, primarily showing a cast section drive roll, means for separating the cast section from the mold (hereinafter called the mold-section separator), and the straightener.
Figure 4:
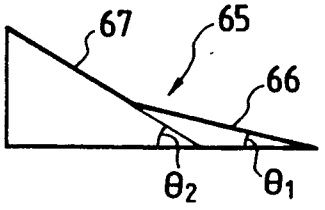
FIG. 4 is a side elevation view of another preferred embodiment of the mold-section separator.

The cast section is taken out of the mold downstream of the cast section drive roll 51 where a mold-section separator 61 having a wedge 62 is provided. The wedge 62 takes out the cast section 3 from the casting groove 12. The take-out angle of the cast section essentially depends on the slope of the surface 63 or wedge angle$\theta$. When casting is carried out steadily, the section leaves the rear end of the wedge 62 (closer to the cast section drive roll 51) after passing the cast section drive roll 51 as shown in FIG. 3, and moves forward, to point Q where the section comes in contact with the wedge 62. Thus, the apparent take-out angle in a steady state can be regarded as $\alpha$. As is obvious from FIG. 3, angle $\alpha$ does not deviate much from wedge angle $\theta$. In order to surely lead the cast section to the straightener, accordingly, it is necessary to control the wedge angle $\theta$. To keep the strain induced by straightening below the strain induce cracking, the wedge angle $\theta$ must be kept at an appropriate value. When the leading end of the cast section and the rear end of the wedge 62 collide, the wedge 62 cannot help the departure of the cast section from the casting groove 12. According to an experiment conducted by the inventors, such collision can be avoided by reducing the clearance $\delta$ between the wedge 62 and the bottom of the casting groove 12 to between 0.05 and 1 mm, or preferably to approximately 0.5 mm. But the clearance $\delta$ need not be limited to the above range. Basically, the clearance $\delta$ may be allowed to be as large as the height of the cast section because collision can be avoided by providing the leading end of the cast section with a cylindrical, notched or otherwise appropriate shape. In an experiment conducted by the inventors, a smooth withdrawal and straightening of the cast section and complete prevention of surface cracking were achieved by keeping the wedge angle in the range of 5 to 60 degrees, as will be elaborated on later. A wedge 65 having two or more surfaces, as indicated by reference numerals 66 and 67 in FIG. 4, tapered first at an angle$\theta_1$, then at a larger angle$\theta_2$, and so on, is preferable. The wedge angle is increased from the first one $\theta_1$ in the range of 13 to 20 degrees by increments of about 15 degrees until the cast section ultimately forms an angle of approximately 30 to 45 degrees with a horizontal plane. Then, a most stable straightening and complete prevention of surface cracking can be achieved. As such, the best straightening is obtained when straightening is performed at several different angles. When the wedge angle$\theta$ is smaller than 5 degrees, straightening induces no problems, such as cracking. But the tip of either of the wedges 62 and 65 becomes so thin that it might be easily bent when coming in contact with the cast section. Also, such wedges increase the take-off distance for the cast section leaving the casting groove. When the wedge angle$\theta$ exceeds 60 degrees, on the other hand, straightening-induced strain increases to such an extent to increase the occurrence of cracking. Also, the steep slope increases the risk of collision between the cast section and wedge 62. Though carbon steel and other common steels for mechanical structures suffice, the wedges 62 and 65 should preferably be made of alloy steels or sintered metals that have higher wear and heat resistance. Cooling the wedges 62 and 65 is also effective for increasing their service life. Wearing and friction resistance of the wedge can be remarkably decreased by using clad metals, applying or spraying oil-containing materials or lubricants (such as $MoS_2$, graphite powder, BN, Teflon and uranium sulfide that are used at high temperatures and mineral, synthetic, vegetable and other general-purpose lubricating oils), forcibly injecting lubricants, applying lubricating plating and other similar pretreatments. The use of roll bearings or other similar devices with the wedge assures a smooth travel of the cast section. Though still disadvantageous in terms of cost, lining the surface of the wedge coming in contact with the cast section with ceramics (such as $Al_2O_3$, $ZrO_2$ and other oxides, $Si_3N_4$, SiC, BN, BN-AlN and other carbides and nitrides, SIALON and other mixtures containing at least one of the oxides, carbides and nitrides mentioned above) remarkably increases the service life of the wedge.

A light rolling unit 71 is provided on the exit side of the mold-section separator 61. The light rolling unit 71 comprises a pair of flat horizontal rolls 72, one placed on top of the other, an electric motor 73 to drive the rolls 72, and a hydraulic screwdown cylinder 74.

Downstream of the light rolling unit 71 is provided a first straightener 81, which is made up of a pair of vertical straightening rolls 82 driven by a hydraulic motor 83 to straighten both sides of the cast section and a screwdown mechanism comprising a hydraulic cylinder 84. The first straightener 81 has a first cast section detector 85 and a second cast section detector 86 that are disposed along the pass line of the cast section.

A second straightener 91 is provided downstream of the first straightener 81. The second straightener 91 comprises a pair of horizontal rolls 92, one placed on top of the other, driven by a hydraulic motor 93 and a screwdown mechanism comprising a hydraulic cylinder 94. The second straightener 91 has a third cast section detector 95 and a fourth cast section detector 96 that are disposed along the pass line of the cast section. Pairs of first guide rolls 88, which are horizontal, are provided between the first cast section straightener 81 and the second cast section straightener 91. Pairs of second guide rolls 98, which are vertical, are provided between the individual rolls making up the second straightener 91.

Figure 5:
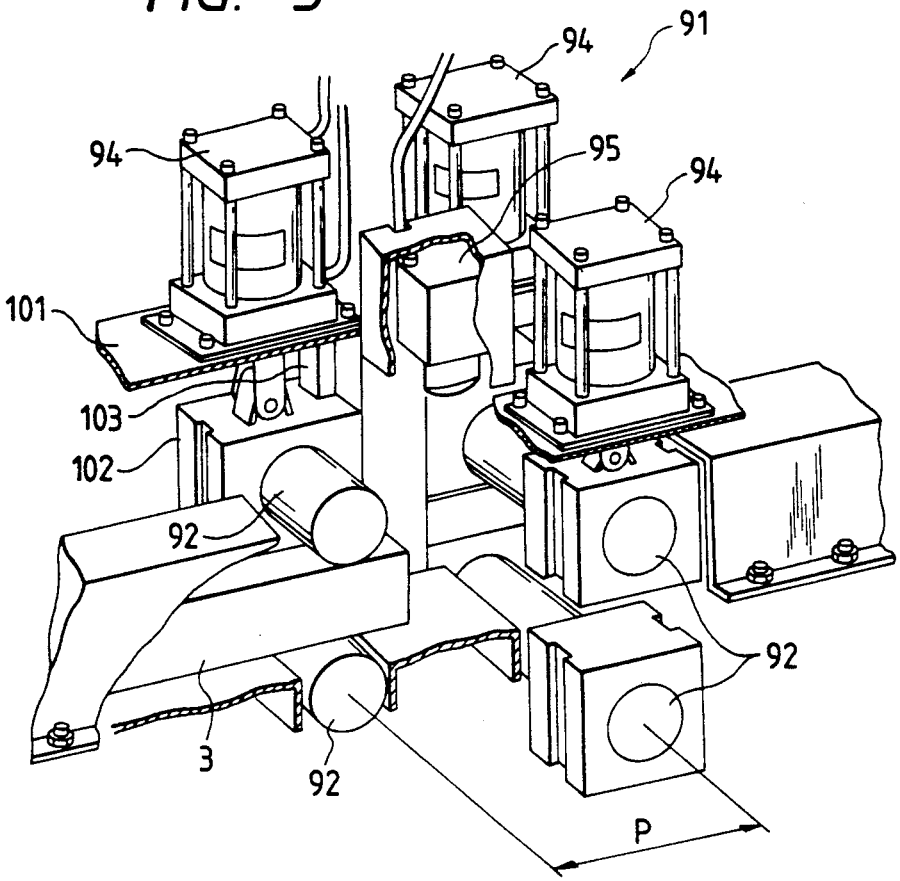
FIG. 5 is a perspective view of the straightener.
Figure 6:
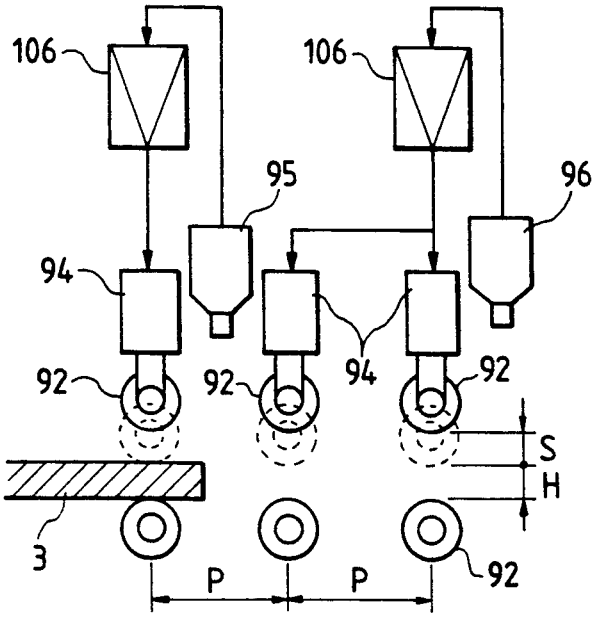
FIG. 6 is a block diagram of a control system to start the straightening rolls based on a signal that is supplied upon detecting the presence of the cast section.

As is obvious from the above, the first straightener 81 and the second straightener 91 are analogous in construction. Therefore, a detailed description of the straightener will now be made by referring to the second straightener 91 shown in FIG. 5. The second straightener 91 has a roll chock 102 that supports a horizontal straightening roll 92. Connected to a hydraulic cylinder 94 fastened to a frame 101, the roll chock 102 is driven up and down by the hydraulic cylinder 94 along a guide 103. One end of the horizontal straightening roll 92 is connected to a hydraulic motor 93. The third and fourth cast section detectors 95 and 96 provided on the pass line of the cast section 3 are infrared detectors responding to infrared radiation from the cast section whose temperature reaches several hundred degrees centigrade. The infrared detectors may have a sensitivity to respond to a temperature of 400° C. or above. Of course, the detectors may also use light, a laser beam, an ultrasonic wave and an electromagnetic wave. They may also be of the camera type. They may be either of the transmission type or of the reflection type. Though the cast section detectors 95 and 96 should preferably be disposed near the straighteners, they may also be installed away therefrom if an appropriate time-delay circuit or other similar device is provided. As the detectors 95 and 96 are connected to a controller 106 as shown in FIG. 6, the hydraulic cylinder 94 moves the straightening roll 92 up and down based on an operation signal from the controller 106, thereby automatically starting the straightening of the cast section. The drive circuit of the hydraulic cylinder 94 and the time-delay circuit mentioned above are integrated in the controller 106. The roll pitch P, stroke S, roll opening H and the number of roll pairs vary with the size and capacity of the continuous caster. When the cast section has a radius of 1000 mm, for example, P is approximately 200 to 250 mm, S is about 50 mm, H is 0.7 to 0.9 times the height (or thickness) of the cast section, and the number of roll pairs is 3.

The cast section drive roll 51 and the straightening rolls 82 and 92 of the first and second straighteners 81 and 91 may not be driven as required. Then, these rolls are rotated by the friction with the cast section. One cast section drive roll 51 and one pair of the straightening rolls 82 and 92 are normally sufficient. But the flexibility of the apparatus will be increased if two or more pairs are provided. The cast section drive roll 51 and the straightening rolls are normally made of plain cast iron or spheroidal graphite cast iron. But they may also be made of cast steel, carbon steel, alloy steel, high-speed steel or ceramics.

On the delivery side of the second straightener 91 is provided a cutting machine 109 that cuts the cast section 3 from the second straightener 91 to the desired length.

Continuous Casting with Rotary Annular Mold

Now a method of continuously casting billets for bars using the apparatus just described.

While the annular mold 11 is rotated by the connected motor and forcibly cooled with sprayed cooling water, molten steel is poured into the tundish 47 from a tilted ladle 42. The molten steel 1 then flows from the tundish 47 to the casting groove 12 through the pouring nozzle 48. The flow rate is controlled by adjusting the opening of the pouring nozzle 48. With the backward flow of the molten steel 1 checked by the tail dam 49 in the casting groove 12, casting proceeds in the direction in which the annular mold 11 rotates. Cooled by the annular mold 11, the molten steel 1 in the casting groove 12 forms a solidifying shell. Meanwhile, inert gas, such as nitrogen or argon, is supplied into the cover 26 from the inert gas supply pipes 27. By covering the top side of the molten steel 1, the inert gas prevents its oxidation and the deterioration of the section 3 being cast.

Solidification of the molten steel 1 begins in areas that are in contact with both sides and the bottom of the casting groove 12 and then proceeds to the top side, thus forming a solidifying shell. A cast section is formed when the molten steel 1 in the casting groove 12 has completely solidified to the inner core. When segregation and center porosity must be avoided, the section being cast must reach the cast section drive roll 51 before solidification is completed. Frictionally constrained between the cast section drive roll 51 and the inner surface of the mold defining the casting groove 12, the section 3 being cast is forcibly sent to the top surface of the wedge 62.

Figure 7:
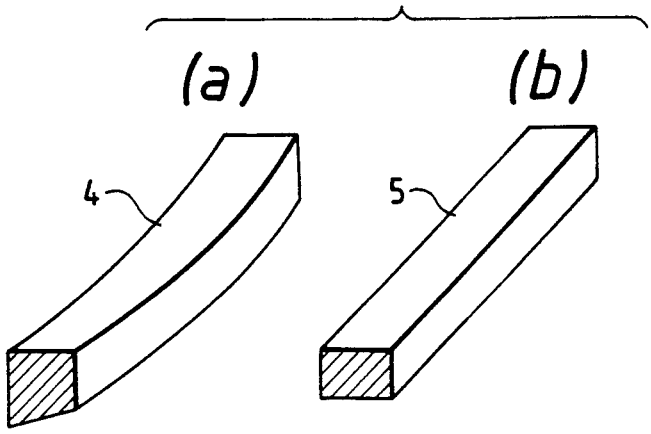
FIG. 7 shows a cast section that is vertically straightened after passing the mold-section separator; (a) and (b) are respectively taken along the line VIIa—VIIa and the line VIIb—VIIb.

After leaving the mold-section separator 61, the cast section 3 reaches the light rolling unit 71 where light rolling is applied. FIG. 7 shows the cross sections of the cast section taken along the line VIIa—VIIa and the line VIIb—VIIb in FIG. 3. By removing the section from the mold before complete solidification, the sensible heat of the section can be effectively utilized with substantial energy savings in the subsequent rolling process. As shown by (a) of FIG. 7, the as-cast section is heavier on the inner side than on the outer side. This profile can be easily obtained by inclining the bottom surface defining the casting groove 12 upwardly toward the inside of the annular mold 11. Because the cast section is compacted by the rolls 72 more greatly on the inner side than on the outer side, the inner side elongates and advances ahead of the outer side, thereby increasing the radius of curvature to such an extent that the cast section 3 becomes less ring-shaped. This permits reducing the strains induced by the straightening applied by the straightening rolls 82 and 92. Because the surface strains induced by straightening are thus effectively reduced, surface cracking of the cast section can be prevented. This pre-straightening light rolling is particularly effective with a cast section having a small radius of curvature (cast in a mold with a small radius) and a large cross-sectional area. The light rolling unit 71 is commonly made up of rolls 72 as illustrated. But a similar effect can be achieved by forging with a reciprocating vibrating surface reduction unit comprising a hydraulic unit, an eccentric cam mechanism or a link mechanism, etc. When the annular mold 1 has a large radius of curvature or the section being cast does not develop much straightening-induced cracking, the light rolling unit 71 or the application of light rolling may be omitted.

This method is also applicable to the subsequent straightening applied to assume the top and bottom sides of the section that is cast to a top-flaring trapezoidal shape. Also, a drive unit or a drive control unit to control the peripheral speed of the individual rolls may be connected to the cast section drive roll 51, vertical straightening rolls 82 and horizontal straightening rolls 92. The compressive force thus steadily applied in the direction of travel permits reducing the surface strains that tend to occur when bent or twisted cast sections are straightened.

Figure 8:
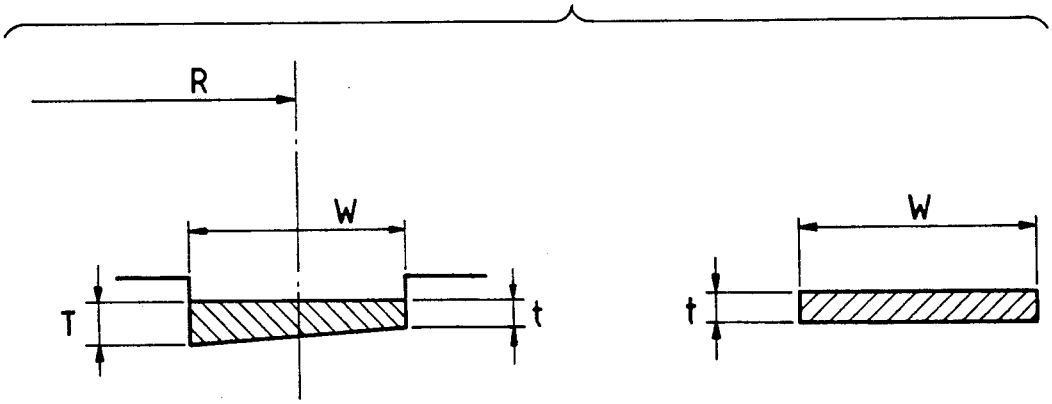
FIG. 8 shows cross sections of a continuously cast plate or strip.

The appropriate thickness difference between the inner and outer sides of the cast section can be determined as described in the following. FIG. 8 shows a slab having a greater thickness on the inner side than on the outer side. If the inner thickness and the outer one of the cast section are T and t ($T>t$), T and t are almost unconditionally derived from the mean radius R of the annular mold and the width W of the cast section. If the cross-sectional shape of the cast section is defined by a ratio $L=W/R$, the thickness ratio T/t should theoretically be equal to $1+6L/(6-L)$ on the basis of the material balance between the arched section and the straightened section before and after the application of light rolling because the cast section subjected to light rolling is caused to elongate more on the inner side than on the outer side. Considering that the above equation represents a theoretical state, the inventors conducted a casting experiment by intentionally varying the values derived therefrom as a means to take into account the influence of variations in actual casting. The results of the experiment were compared with the occurrence of cracking in the straightened cast sections. Then, the above theoretical equation proved to give a thickness ratio that does not cause straightening-induced cracking, as will be discussed later in the description of Example 1.

On leaving the light rolling unit 71, the cast section passes through the first straightener 81 and the first and second cast section detectors 85 and 86. When the hydraulic motor 83 and hydraulic cylinder 84 are actuated by the signals from the detectors 85 and 86, the vertical straightening rolls 82 grip the cast section. The widthwise light reduction applied by the vertical straightening rolls 82 straightens the cross-sectional profile of the cast section to make both sides thereof straight and parallel to each other. The cast section 3 leaving the first straightener 81 is detected by the third and fourth cast section detectors 95 and 96, with the signals therefrom actuating the hydraulic motor 93 and hydraulic cylinder 94 connected to the second straightener 91. The horizontal straightening rolls 92 vertically apply a light reduction on the cast section to make the top and bottom surfaces thereof straight and parallel to each other. Then, the cutting machine 109 cuts the cast section leaving the second straightener 91 to the desired length, with the cut section delivered to the subsequent hot-rolling or other processes.

EXAMPLE 1

Table 1 shows the essential chemical composition of the carbon steel continuously cast in this test. As different heats were cast by the method according to this invention and the conventional method tested for the purpose of comparison, the ranges in which their chemical composition falls are shown.

TABLE 1

Chemical Composition of Carbon Steels (Common to Both Preferred Embodiments and Conventional Methods Tested for Comparison)

| C | Si | Mn | P | S | Al |
|---|---|---|---|---|---|
| 0.30–0.32 | 0.30–0.32 | 0.98–1.020 | 0.010 max | 0.015 max | 0.046–0.050 |

(in percent by weight)

1) Evaluation of Wedge Angle

Relationships between the wedge angle used in straightening, straightening condition and the quality of the straightened cast sections were investigated.

While the employed wedge angles are shown in Table 2, other casting conditions are listed in the following.

Casting method: Continuous casting with horizontal mold having endless casting groove
Cast section size: 40 mm square
Radius of mold R: 1000 mm
Casting speed: 7.0 m/min.
Superheating: 36° C.
Mold material: Copper alloy
Wedge width: 35 mm
Wedge angle: See Table 2
Cast section drive roll: Parallel roll
Cast section drive roll radius: 150 mm
Cast section drive roll width: 40 mm
Light rolling: Not applied As is obvious from the test results shown in Table 2, smooth straightening and surface crack-free straightened sections were obtained with the wedge angle ranging between 5 and 60 degrees, with the particularly preferably wedge angle falling within the range of 13 to 20 degrees. With increasing wedge angle, friction between the wedge and the cast section and the incidence of surface cracking showed a tendency to increase. The wedge angle exceeding 70 degrees proved to be practically intolerable as direct collision resulted to cause the stoppage or bending of the cast section.

TABLE 2

Angles of Straightening Wedges and Conditions of Straightened Cast Sections

| No. | Angle of Wedge (°)$\theta$ | Substantial Withdrawing Angle (°)$\alpha$ | Conditions of Straightened Cast Sections | Defects (Cracks) in Cast Sections |
|---|---|---|---|---|
| 1 | 5 | 3 | Not rigid enough wedge | None |
| 2 | 10 | 7 | Good; worn wedge tip | None |
| 3 | 13 | 10 | Good; no wedge wear | None |
| 4 | 20 | 14 | Good; no wedge wear | None |
| 5 | 25 | 16 | Good; slightly worn cast section | None |
| 6 | 30 | 20 | Good; slightly worn cast section | None |
| 7 | 60 | 44 | Good; worn cast section | None |
| 8 | | 53 | Poor; occasional | Very |

TABLE 2-continued

| No. | Angle of Wedge (°)θ | Substantial Withdrawing Angle (°)α | Conditions of Straightened Cast Sections | Defects (Cracks) in Cast Sections |
|---|---|---|---|---|
| | | | collision | slight cracks (sporadic) |

Angles of Straightening Wedges and Conditions of Straightened Cast Sections

2) Prevention of Straightening-Induced Cracking with Varying Cast Section Profiles According to the Method of This Invention and Conventional Methods Straightening-induced cracking was evaluated with continuously cast sections having varying thicknesses on the inner and outer sides which are determined by the ratio L (=W/R) as discussed previously. The employed casting conditions are as follows.

Casting method: Continuous casting with horizontal mold having endless casting groove
Cast section size: Shown in Table 3 (by W, T and t)
Radius of mold R: 1000 mm
Casting speed: 7.0 m/min.
Superheating: 35° C.
Mold material: Copper alloy
Wedge width: Width of cast section W-5 mm
Wedge angle: 15 degrees
Cast section drive roll: Tapered roll
Light rolling: Applied (until thickness became t throughout the entire width)
Theoretical thickness ratio T/t:

$$T/t=1+6L/(6-L),$$

where L=W/R

TABLE 3

Shape of Cast Sections and Cracks Resulting from Straightening

| No. | Classification | R | Size (mm) W | T | t | Thickness Ratio T/t ① | Theoretical Thickness Ratio T/t ② | Error in Thickness Ratio \|(② − ①)/②\| | Surface Cracks in Straightened Cast Section |
|---|---|---|---|---|---|---|---|---|---|
| 1 | Preferred | 1000 | 40 | 40 | 40 | 1.00 | 1.04 | 4 | None |
| 2 | embodiments | | | 41 | 40 | 1.03 | 1.04 | 1 | None |
| 3 | | | 100 | 11 | 10 | 1.1 | 1.1 | 2 | None |
| 4 | | | | 13 | 10 | 1.3 | 1.1 | 18 | None |
| 5 | | | | 14 | 10 | 1.4 | 1.1 | 27 | None |
| 6 | | | | 15 | 10 | 1.5 | 1.1 | 36 | Small edge cracks |
| 7 | | | 300 | 22 | 15 | 1.5 | 1.32 | 15 | None |
| 8 | | | | 25 | 15 | 1.7 | 1.32 | 26 | None |
| 9 | Conventional | 1000 | 300 | 27 | 15 | 1.8 | 1.32 | 36 | Edge cracks |
| 10 | methods tested | | | 28 | 15 | 1.9 | 1.32 | 44 | Large edge cracks |
| 11 | for comparison | | | 15 | 15 | | Not calculated as light rolling was not applied | | External collapse and internal rupture induced by straightening |

Table 3 shows the results of the test conducted on broader cast sections having varying thicknesses on the inner and outer sides thereof. By applying light rolling, the inner side was preferentially allowed to elongate to reduce the curvature of the cast section, thereby inhibiting the occurrence of straightening-induced cracking.

The results shown in Table 3 were obtained from the casting of sections whose thicknesses on the inner and outer sides were derived from the theoretical equation described before, with intentionally conceived errors included therein. Obviously, no cracking occurred when the absolute value of the error in the thickness ratio between the inner and outer sides was not larger than about 30%. With the thickness difference between the inner and outer sides reduced, the cast section after light rolling proved to have a uniform thickness throughout the entire width thereof and a resulting satisfactory profile.

But edge cracking occurred when the absolute value of the error exceeded 30%.

The cast section No. 11 shown at the bottom of Table 3 had no thickness difference between the inner and outer sides. When straightened, a tensile force acting on the inner side caused transverse cracking, while a straightening reaction force working on the outer side collapsed the outer edge of the section. As a consequence, the cast section had a very poor profile.

The plate and strip continuously cast by the method being discussed always require straightening. And now it is obvious that straightening-induced cracking can be completely prevented by keeping the thickness difference between the inner and outer sides thereof within a specific limit from the theoretically derived one. Besides, a wide variety of sections can be continuously cast using molds of varying profiles that can be easily determined based on the thickness ratio derived from the simple theoretical equation described previously.

The method of radial straightening just described is also applicable to vertical straightening. Especially when casting relatively large blooms, straightening-induced cracking in the vertical direction can be prevented by providing a given dimensional difference in the widthwise direction.

Multi-Strand Continuous Casting

Figure 9:
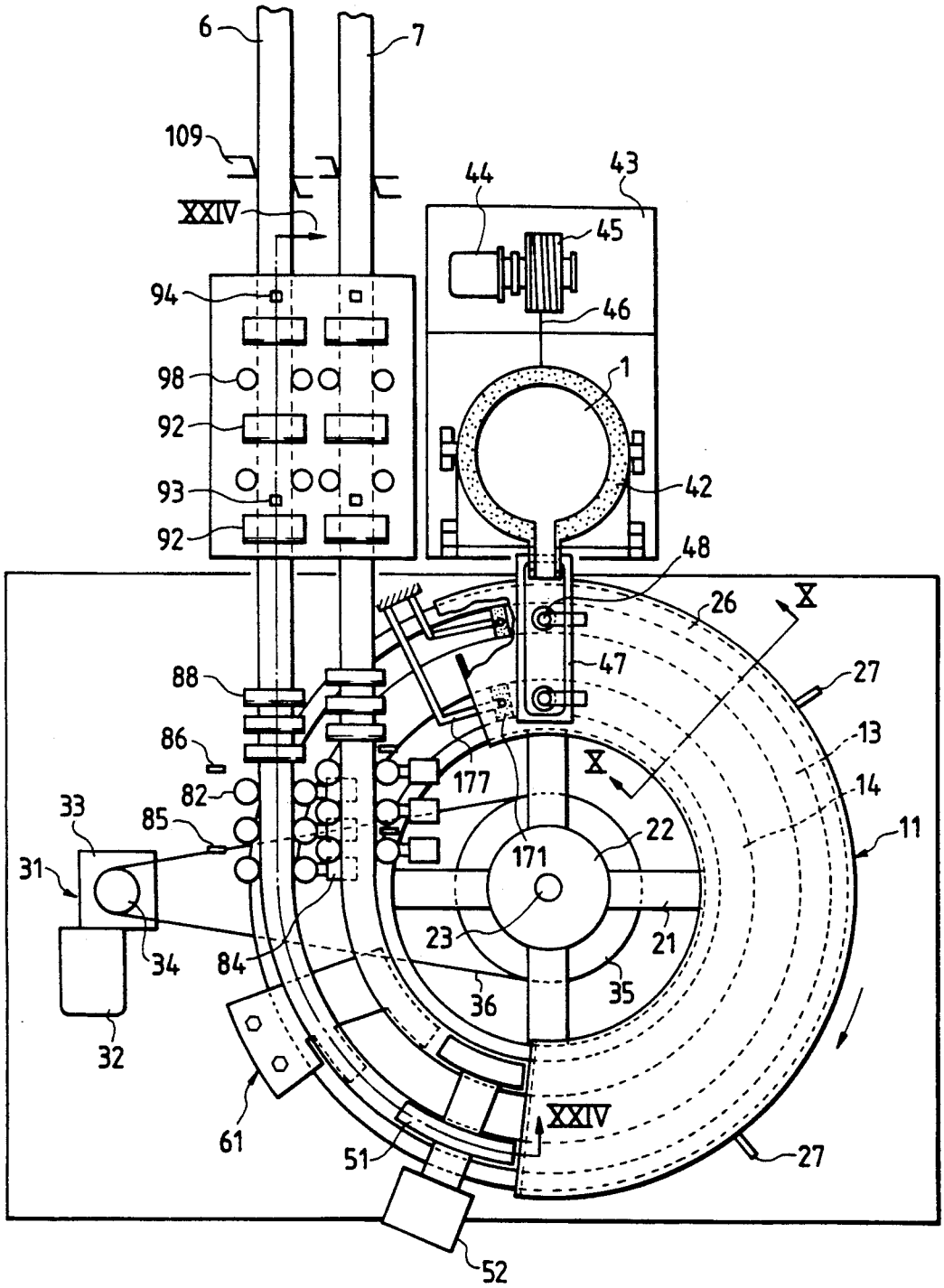
FIG. 9 is a plan view of a two-strand continuous caster and a straightener.

If two or more sections are simultaneously cast on one caster, productivity can be increased twofold or threefold. FIG. 9 shows a two-strand continuous caster that casts two billets for bars at a time. In FIG. 9, the devices and members similar to those in FIGS. 1 and 2 are denoted by the same reference numerals, with detailed descriptions thereof omitted.

Figure 10:
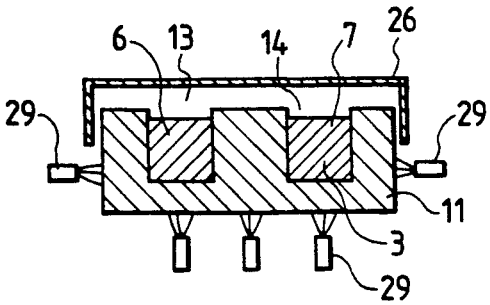
FIG. 10 is a cross-sectional view of an annular mold taken along the line X—X of FIG. 9.
Figure 11:
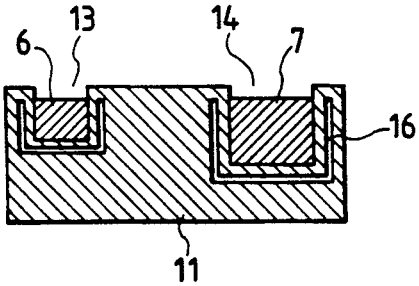
FIG. 11 is a cross-sectional view of another embodiment of an annular mold.

An annular mold 11 has two casting grooves 13 and 14. A tundish 47 has two pouring nozzles 48 individually leading into the casting grooves 13 and 14, which may have the same cross section as shown in FIG. 10 or different cross sections as shown in FIG. 11. FIG. 10 also shows a cover 26 placed over the annular mold 11 and mold cooling spray nozzles 29. FIG. 11 shows a cooling water channel 16 provided in the annular mold 11. The annular mold 11 shown in FIG. 11 is cooled not by the water sprayed from the nozzles 29 but by the water circulated through the channel 16. Continuous casting with this apparatus is performed in the same manner as that described by reference to FIGS. 1 and 2.

Casting speed unavoidably varies between the individual strands because of the difference in the radius of curvature of the casting grooves 13 and 14. On the other hand, productivity is defined by the product V·S of the casting speed V and the cross-sectional area S of the casting groove. If the casting grooves have the same cross-sectional area, accordingly, productivity of the individual casting grooves varies with the difference in the casting speed. Few technical problems arise from the installation of an independent rolling mill downstream of a continuous caster. With a multi-strand caster, however, the casting groove 14 on the inner side of the annular mold 11 must have a larger cross-sectional area to absorb the difference in the casting speed, as shown in FIG. 11. The cross-sectional area of the casting grooves 13 and 14 can be easily calculated. If the targeted production rate is Q ($m^3$/min.), production rates of the two strands are $Q_1$ and $Q_2$, rotating speed of the mold is N (rpm), diameters of the two strands are $D_1$ and $D_2$ (m) ($D_1 > D_2$), casting speeds of the two strands are $V_1$ and $V_2$ (m/min.), cross-sectional areas of the two casting grooves are $S_1$ and $S_2$ ($m^2$), and the ratio between the circumference and diameter of a circle is $\pi$, then $$V_1 = \pi D_1 N$$

$$V_2 = \pi D_2 N$$

$$Q_1 = V_1 S_1 = \pi D_1 N S_1$$

$$Q_2 = V_2 S_2 = \pi D_2 N S_2$$

Because $Q = Q_1 = Q_2$, the cross-sectional area is $$S_2 = S_1 (D_1/D_2)$$

Accordingly, the cross-sectional area $S_2$ of the inner casting groove should be made larger than that of the outer one according to the ratio of diameters $D_1/D_2$ as $D_1 > D_2$.

Multi-Strand Continuous Casting and Rolling

Figure 12:
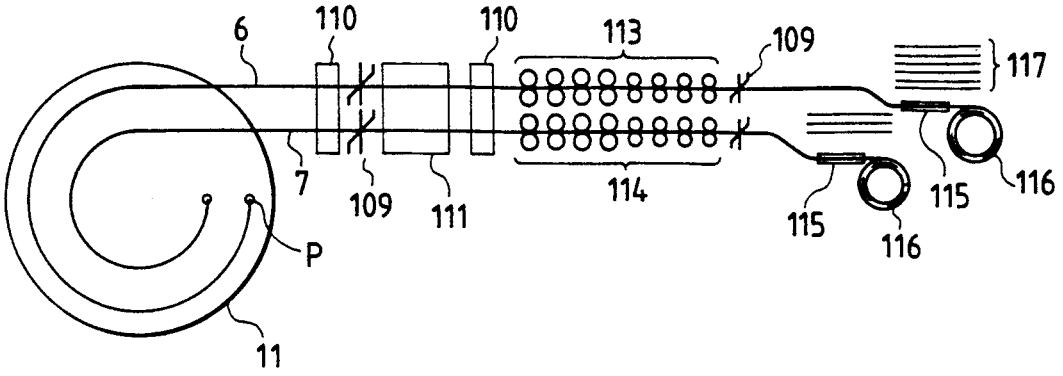
FIG. 12 is a schematic illustration of a line in which two strands of continuously cast metal are subsequently rolled through two rolling mills.

FIG. 12 shows a process for continuously casting and rolling two strands of bars. The number of rolling mill trains used in this process is equal to the number of continuously cast strands.

Molten steel poured from the pouring point P solidifies into an external cast section 6 and an internal cast section 7 as the annular mold 11 rotates. The cast sections 6 and 7 are cut to the desired length by the cutting machine 109, kept at a high temperature by a heating-/holding furnace 111, and then continuously rolled into desired products through two tandem rolling mill trains 113 and 114. With the quality improved by a controlled cooling device 115, the rolled products are processed into finished products in coil 116 or in cut length 117 form. The controlled cooling device 115 applies such treatments as rapid cooling in water or other cooling medium, hardening, cooling in warm water, spray cooling, annealing, tempering, lead-bath treatment, hot transformation treatment, solution treatment, and blueing. Although not always required, the cast section at high temperatures may be passed through a descaling device 110 to remove the unwanted oxide from the surface thereof.

Figure 13:
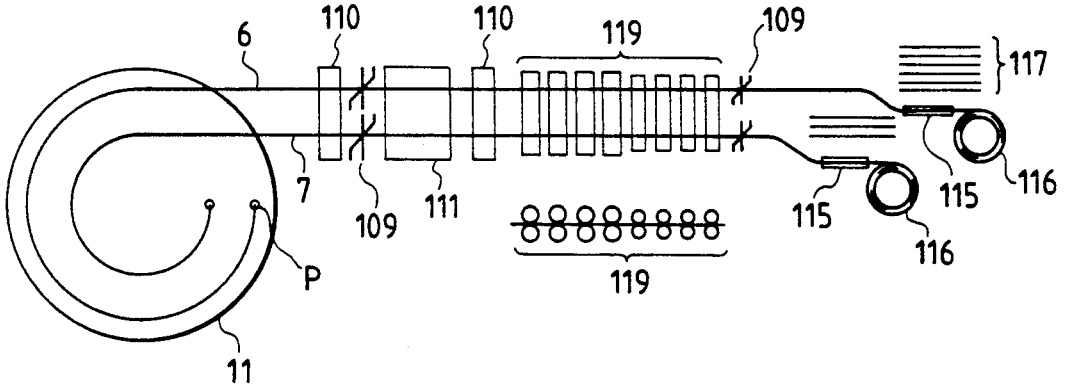
FIG. 13 is a schematic illustration of a line in which two strands of continuously cast metal are subsequently rolled through one rolling mill.

FIG. 13 shows a more economical process in which one tandem rolling mill train 119 is combined with a multi-strand continuous caster.

Figure 14:
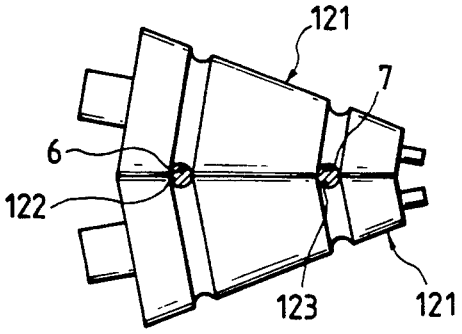
FIG. 14 is a schematic illustration of a roughing roll used in direct rolling of cast sections.

FIG. 14 shows roughing rolls for use in multi-strand rolling. In multi-strand casting, casting speed differs from strand to strand. Accordingly, two passes 122 and 123 of different sizes are spaced along the axis of a roll 121 that is shaped like a truncated cone. This roll simultaneously rolls two strands of cast sections 6 and 7 by accommodating for the casting speed difference therebetween. But the difference in production rate between the two strands remains uncorrected.

Figure 15:
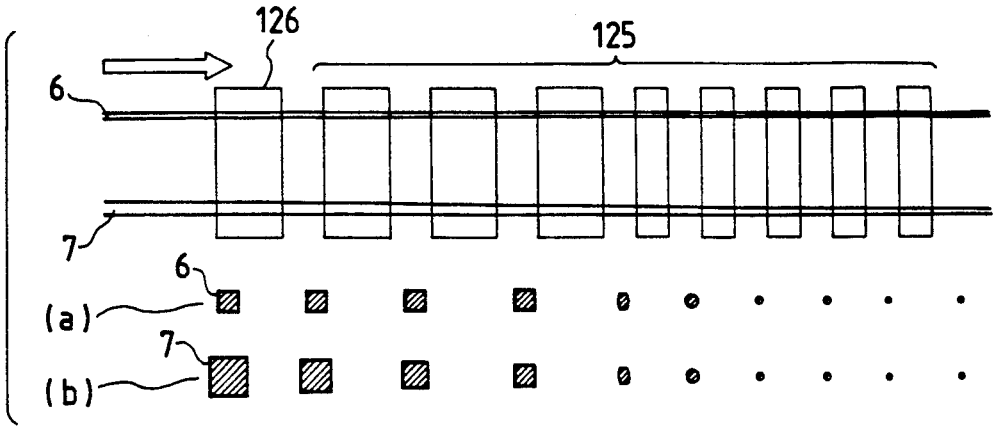
FIG. 15 shows a no-load passing method to compensate for the difference in casting speeds, whereby cast sections of different sizes can be simultaneously subjected to finish rolling.
Figure 16:
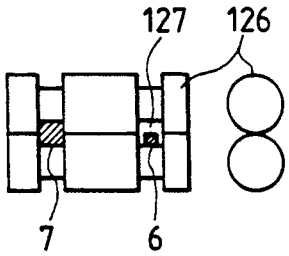
FIG. 16 shows a cast section that is passed through a stand without load application according to the method shown in FIG. 15.
Figure 17:
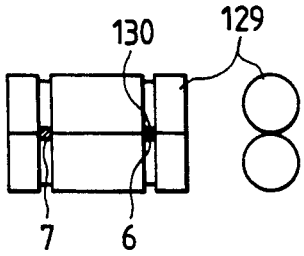
FIG. 17 shows two cast sections that are simultaneously subjected to finish rolling according to the method shown in FIG. 15.

FIGS. 15 to 17 show a process in which simultaneous multi-strand rolling is performed without using a reducing roll. This process permits simultaneous rolling while compensating for the difference in production rate, a drawback of multi-strand casting, by changing the size of the cast section. This process employs a rolling mill train 125 that has one or more strands of rolls to perform no-load or extra-light rolling as required. The cast section 7 on the inner side that has a larger cross-sectional area is rolled first until the size difference between two strands is eliminated. After the size difference has been thus eliminated, two strands of cast sections are finished rolled through the rolling passes of the same shape. The roll pass profile on the leading stand differs from that on the finishing stand. On the leading stand 126, the outer cast section 6 passes through a pass 127 without getting reduced, whereas the inner cast section 7 is reduced by the pass 127. On the finishing stand 129, both cast sections 6 and 7 are rolled through a pass 130 to the same size. Changes in the cross-sectional area of the outer and inner cast sections are shown at (a) and (b) of FIG. 15. Rolling proceeds from left to right, with the inner and outer sections finished under the same condition on and after the third stand. This figure shows a mill train consisting of eight stands, but the number of stands is by no means limited thereto. This method is advantageous where there is not enough space to install a rolling mill train between the strands of the continuous caster.

Figure 18:
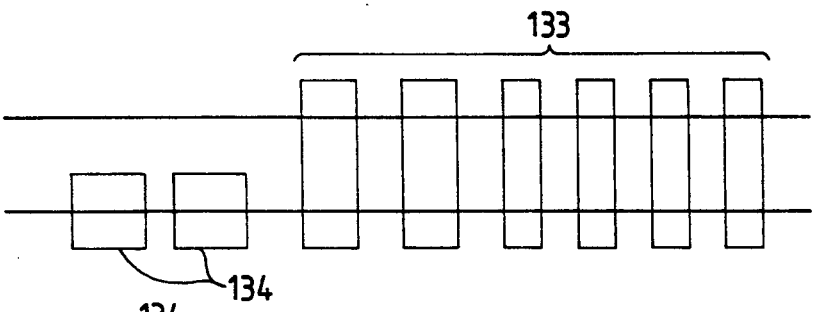
FIG. 18 is a plan view of a tandem rolling mill line with a sizing stand installed upstream thereof.
Figure 19:
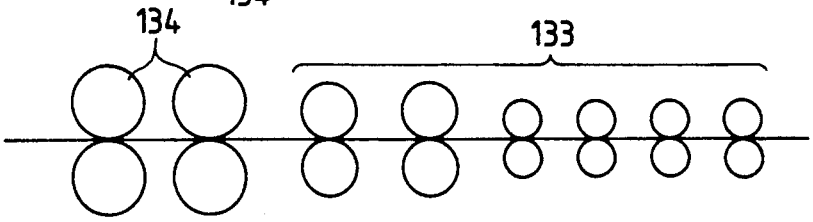
FIG. 19 is a side elevation of the tandem rolling mill line shown in FIG. 18.

FIGS. 18 and 19 show a layout based on the same concept as the one shown in FIG. 17. But it is applicable where there is enough space to provide a rolling mill train between the strands of the continuous caster. One or more sizing mill stands 134 to eliminate the size difference between two strands of cast sections are provided on the entry side of a rolling mill train 133. The number of sizing mill stands is not specifically limited, but at least one stand is required. The provision of one or more sizing mill stands assures a more satisfactory simultaneous rolling.

EXAMPLE 2

Casting and rolling operations performed according to the method of this invention and a conventional method will be described below.

Table 4 shows the essential chemical composition of the carbon steel continuously cast in this test.

TABLE 4

Chemical Composition of Carbon Steels (Common to Both Preferred Embodiments and Conventional Methods Tested for Comparison)

| C | Si | Mn | P | S | Al |
|---|---|---|---|---|---|
| 0.30–0.32 | 0.30–0.32 | 0.98–1.020 | 0.010 | 0.015 | 0.046–0.050 |

TABLE 4-continued

| Chemical Composition of Carbon Steels (Common to Both Preferred Embodiments and Conventional Methods Tested for Comparison) | | | | | |
|---|---|---|---|---|---|
| C | Si | Mn | P | S | Al |
| | | | max | max | |

(in percent by weight)

The casting and rolling conditions employed in the test area as follows.

Casting method: Continuous casting with horizontal mold having endless casting groove
No. of strands: 2
Radius of outer mold: 1500 mm
Size of outer cast section: 49 mm square
Casting speed of outer strand: 10.4 m/min. (1.1 rpm)
Radius of inner mold: 1000 mm
Size of inner cast section: 60 mm square
Casting speed of inner strand: 7.0 m/min. (1.1 rpm)
Superheating: 36° C.
Quantity of continuously cast molten steel: 300 kg
Material of tail dam: Boron nitride (BN)
Rolling equipment: 8-stand continuous hot-rolling mill train with coiling facilities
Size of finished product: 25 mm diameter (both inside and outside)
Material of dummy bar: Carbon steel for machine structural use according to JIS G 3102, S10C The front dam was made by forming fibers of $Al_2O_3$. The pouring rate of molten steel was controlled by means of a stopper driven by a hydraulic cylinder.

The cast section before the hot rolling mill train was kept at 1150° C. by high-frequency induction heating. As the cast sections reaching the heater had a temperature of 1130° to 1150° C., the desired rolling temperature was obtained by consuming only about 10 to 20 kw of electricity.

The products made by direct rolling the continuously cast sections were evaluated.

When one rolling mill train was provided to each strand, the integrated product yield from the cast section was 99.8% for the outside strand and 99.5% for the inner strand. The difference in yield was due to the different cropping rates which resulted from the difference in section size between the inner and outer strands. Anyway, both inner and outer strands exhibited high product yields.

When only one rolling mill train was provided to cover two strands, the outer strand was passed through three stands without receiving rolling load. The resulting product yield was completely the same as in the above case.

Next, 49 mm square cast sections were rolled through the inner and outer passes of the reducing roll. The product yield exceeded 99.6%. Because of the structural limit of the reducing rolls, the rolled products normally do not have satisfactory roundness. To make up for this shortcoming, earlier rolling was performed with larger drafts and finish rolling was performed with a smaller draft. The reduction ratios (cross-sectional ratio) employed in rolling a 49 mm square section into a 25 mm diameter round section were 2.1 at the exit end of No. 2 stand, which performed rough rolling in conjunction with No. 1 stand, 1.8 at the exit end of No. 4 stand, which performed intermediate rolling with No. 3 stand, 1.2 at the exit end of No. 6 stand, which performed finish rolling with No. 5 stand, and 1.08 at the exit end of No. 8 stand, which performed final finish rolling with No. 7 stand. The roundness of the obtained products was kept within a close tolerance of 50 μm. The above method that attains higher dimensional accuracy by decreasing the reduction ratio toward the end of a rolling process has been employed conventionally. The reducing roll can also be applied to a process in which the production rate of the inner and outer strands is balanced by rolling cast sections of different sizes.

Next, simultaneous rolling was performed with two stands of sizing mills for the inner strand. While the inner strand was 60 mm square, the outer strand was 49 mm square. By sizing the inner strand with a reduction ratio of about 1.5, the size of both strands was unified to about 49 mm square. Through six stands of roughing and finishing stands, the cast sections were rolled into 25 mm diameter wire rod. The product yield with respect to molten steel exceeded 99.6%.

Start of Continuous Casting and Top Processing

Continuous casting is started with or without a dummy bar.

First, continuous casting started with a dummy bar will be described.

The dummy bar passes through a three-dimensional path in the annular mold 11, straighteners 81 and 91, and so on, as shown in FIGS. 1 and 2. Therefore, the dummy bar must be made up of a link mechanism or other similar flexible mechanisms that can bend with two or more, preferably three or more, degrees of freedom in the casting direction.

Figure 20:
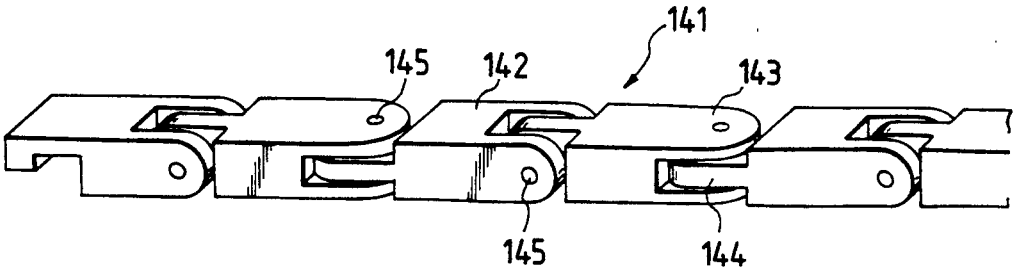
FIG. 20 is a perspective view of a dummy bar according to this invention.

FIG. 20 shows an example of a dummy bar used for starting continuous casting. A dummy bar 141 is made up of a link mechanism that can bend with two degrees of freedom. The head 143 of a link 142 is rotatably connected to the tail 144 of an adjoining link 142 by means of a coupler 145.

Figure 21:
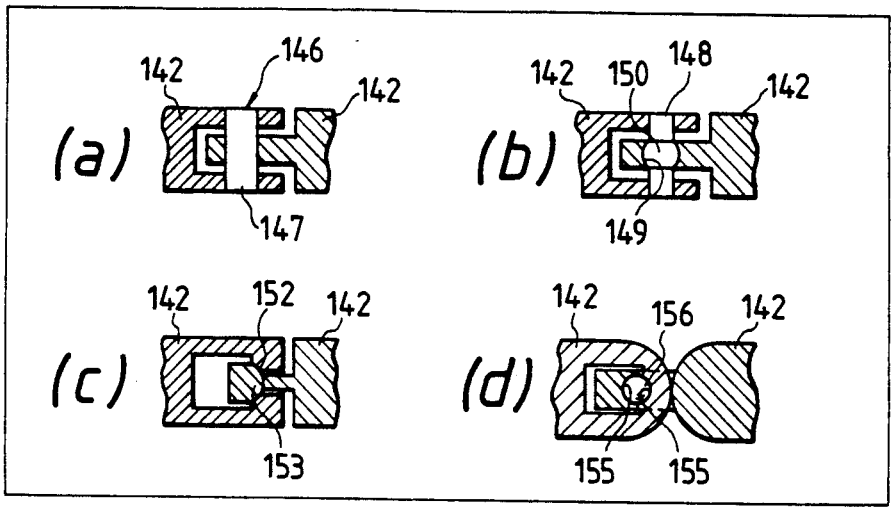
FIG. 21A–D shows cross sections of dummy bar couplers.
Figure 22:
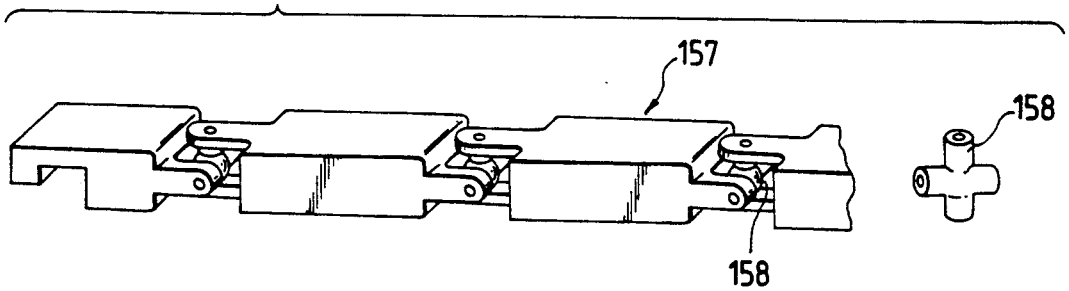
FIG. 22 is a perspective view of another embodiment of the dummy bar according to this invention.
Figure 23:
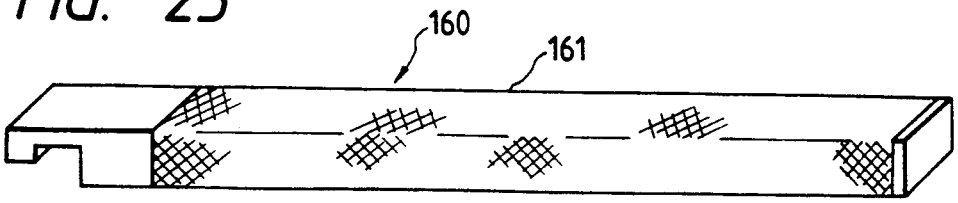
FIG. 23 is a perspective view of still another embodiment of the dummy bar according to this invention.

FIG. 21 shows several methods of link coupling. A coupler 146 shown at (a) is the simplest, consisting of a straight pin 147. A coupler 148 shown at (b) has a spherical portion 150 in the middle of a pin corresponding to a spherical seat 149 at the tail 144 of a link 142. A link 142 shown at (c) has a spherical seat 152 at its head 143 and a spherical projection 153 at its tail 144. A link 142 shown at (d) has a spherical seat 155 at its head 143 and tail 144, with a ball 156 inserted therebetween. The spherical seats in these couplers prevent the loosening of connection that can occur when the link mechanism rotates. FIG. 22 shows a dummy bar 157 made up of links 142 whose head 143 and tail 144 are connected together by means of a cruciform metal coupler 158. FIG. 23 shows a flexible dummy bar 160 made up of bundles of small-diameter wires 161. For example, piano wire or other extra-fine metal wires (0.1 to 0.2 mm in diameter) may be fabricated into wire netting or other appropriate forms.

Among the examples described above, the one shown in FIG. 23 is particularly simple and preferable. The dummy bar need not be made of any special material. Carbon steel or other similar material is sufficient. The head of the dummy bar serves as a member to prevent the outflow of molten steel. Its use is by no means limited to multi-strand casting.

To start continuous casting, a tail dam 49 and a dummy bar, such as the one designated by 141, are inserted in the casting grooves 13 and 14. Then, molten steel 1 is poured into a space defined by the tail dam 49 and dummy bar 141. When the molten steel reaches the desired level, which is equal to the height of the section to be cast, the dummy bar is moved forward to initiate withdrawal (see FIG. 1 or FIG. 9). The dummy bar 141 can be easily moved forward by driving the rotating means of the annular mold 11 or the cast section drive roll 51 and straighteners 81 and 91. The dummy bar 141 can be moved forward by the rotation of the annular mold 11 alone. But pinching the dummy bar with the cast section drive roll 51 and the straighteners 81 and 91 provides a surer withdrawal. Use of a suitable dummy bar recovery device, which is connected to the dummy bar, assures a more satisfactory operation.

Figure 24:
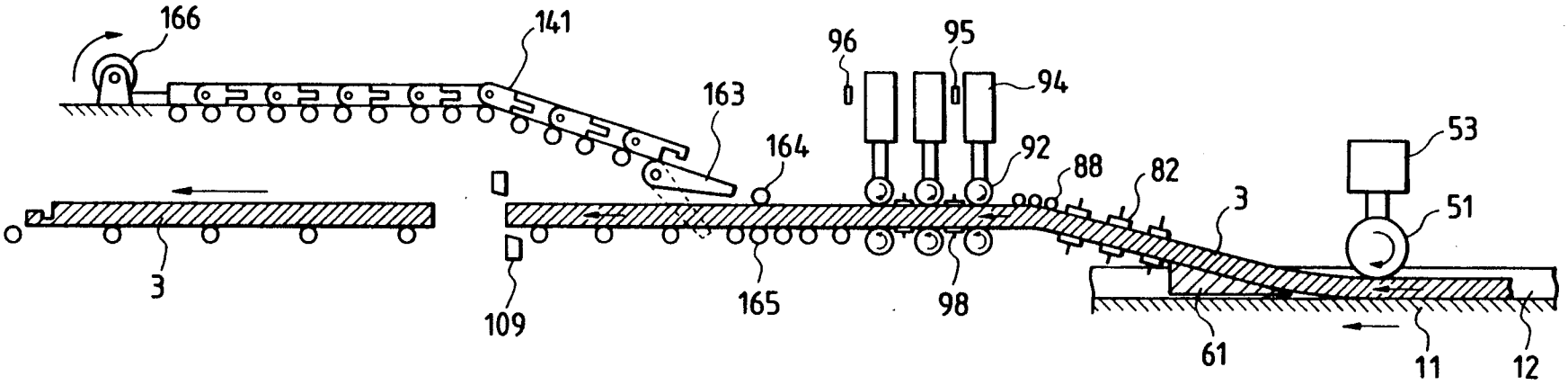
FIG. 24 is a cross-sectional view of a dummy bar in use taken along the line XXIV—XXIV of FIG. 9.

FIG. 24 shows a casting operation with a dummy bar 141, as viewed in the direction of the line XXIV—XXIV of FIG. 9. Reference numeral 163 denotes a dummy bar splitting swing frame, 164 a cast section depressing roll, 165 a roller table, and 166 a dummy bar holder. The dummy bar 141 is separated from the cast section 3 and coiled up when its leading end reaches the dummy bar splitting swing frame 163. Meanwhile, the cast section 3 runs forward over the roller table, is cut to the desired length, and is delivered for subsequent processing.

Now, a casting process that is started without employing a dummy bar will be described in the following.

Figure 25:
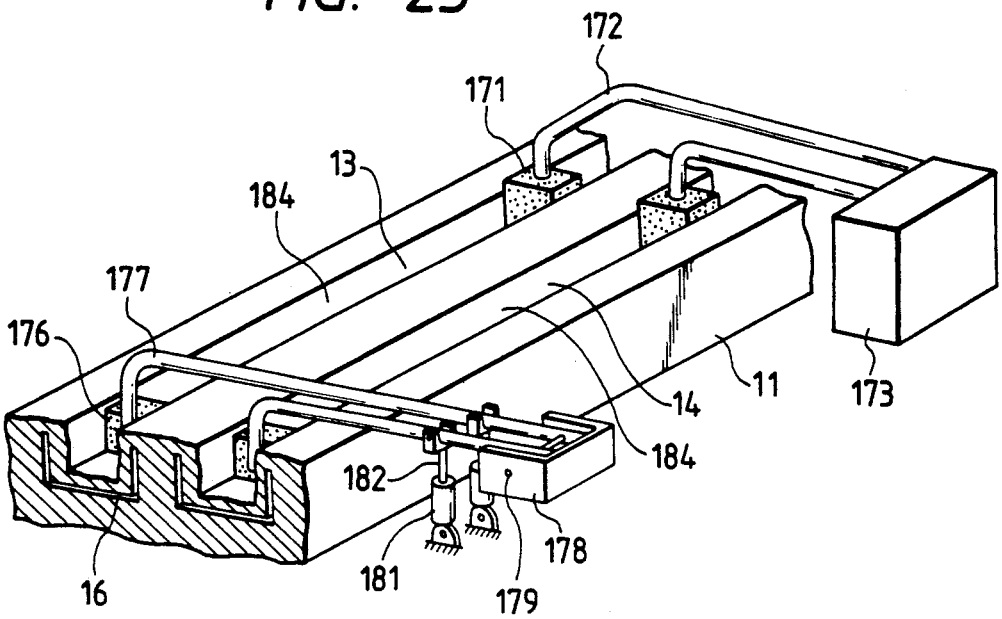
FIG. 25 is a perspective view of an initial pouring space according to this invention.

In this method, a tail dam to prevent the back flow of molten steel is used as mentioned previously. Likewise, a front dam to hold molten steel is used when starting casting. FIG. 25 shows the condition of the pouring point in a multi-strand caster. A tail dam 171 is supported by a support frame 173 through a holding arm 172. The front end of a front dam 176 is held by the tip of a supporting arm 177 so as not be washed or pushed forward by the stream of molten steel. The rear end of the supporting arm 177 is connected to a frame 178 by means of a pin 179, with the rod of a hydraulic cylinder 181 connected to a point close thereto. Molten steel is poured into a space between the front dam 176 and the tail dam 171. An open-top space defined by the front dam 176, tail dam 171 and casting grooves 13 and 14 constitutes an initial pouring space 184. Molten steel is poured into the initial pouring space 184 using a pouring means (not shown). The pouring rate of molten steel is controlled so that the molten steel level in the two casting grooves 13 and 14 rises at the same speed. When the molten metal level reaches the desired height of the section to be cast, rotation of the annular mold 11 is started. When the annular mold 11 begins to rotate, the hydraulic cylinder 181 is actuated to separate the supporting arm 177 from the front dam 176. In single-strand casting, the front dam 176 may not be supported. Even in multi-strand casting, the front dam 176 may not be supported if the individual initial pouring spaces are filled under the completely same condition or if the height of the cast section is not important. Generally, however, it is difficult to make the molten steel level in the different initial pouring spaces 184 completely equal. Therefore, it is preferable to make a provision that will permit each front dam 176 to be released independently of the other. Although the illustrated mechanism to support the front dam 176 is sufficient, any other structures may be used so long as they can adequately support and smoothly release the front dam 176. The one described herein is of the simplest structure. The front dam can be easily detached and moved by means of a hydraulic or pneumatic cylinder, a link mechanism, an eccentric cam or other similar devices. The front and tail dams are slidable with respect to the mold.

After the operation is started, the section is continuously cast by controlling the pouring rate of molten steel and the withdrawing speed so that a constant section height is maintained. The desired section height can be maintained up to the tail end of the section by simultaneously stopping pouring and withdrawing and waiting until the last portion of the section solidifies. The front dam 176 that prevents the outflow of molten steel may be made of common metals, such as carbon steel. But those made of consumable materials, formed refractories and formed refractory fibers can be used as disposable dummy bars. Wood and compressed paper are typical examples of consumable materials. Refractory fibers of $Al_2O_3$ and $SiO_2$ may be compacted into the desired form. Also, refractory materials containing at least one of $Al_2O_3$, $SiO_2$, BN, SiC, AlN, $ZrO_2$, MgO, CaO and graphite may be compacted into the desired form. If thoroughly dried, even clay and mortar can serve the purpose. The reason for this is as follows. While travelling forward, the molten steel poured initially cools down to a temperature near the solidification point. Therefore, the molten steel solidifies the moment (mostly within 5 seconds) it reaches the front dam, as a result of which the solidified shell of the molten steel serves as the front dam, instead of burning it down. As such, the design of the front dam of consumable materials can be easily determined by taking into account the temperature and solidification time of the molten steel. In casting carbon steel (with a melting point at 1490° C.), for example, a 20 to 30 mm thick wood front dam proved to serve the purpose. Other refractory materials also proved applicable. The dams to prevent the outflow of molten steel can be used not only in multi-strand casting but in single-strand casting. When the front dam is made of metal, some consideration is required. The front dam of metal must be short, or curved if long. Required to pass through the intricately shaped straighteners 81 and 91 as shown in FIG. 9, the front dam must be made short enough to avoid collision therewith. The length can be easily determined by considering the geometrical conditions offered by the width and height of the path through the straighteners, and driving means such as rolls. But this problem is not a very serious one. In casing carbon steel, for example, a front dam of carbon steel can serve the purpose if its thickness is over 2 mm. Practically, any dam will serve the purpose, without failing, if it has a thickness of 10 mm.

Figure 26:
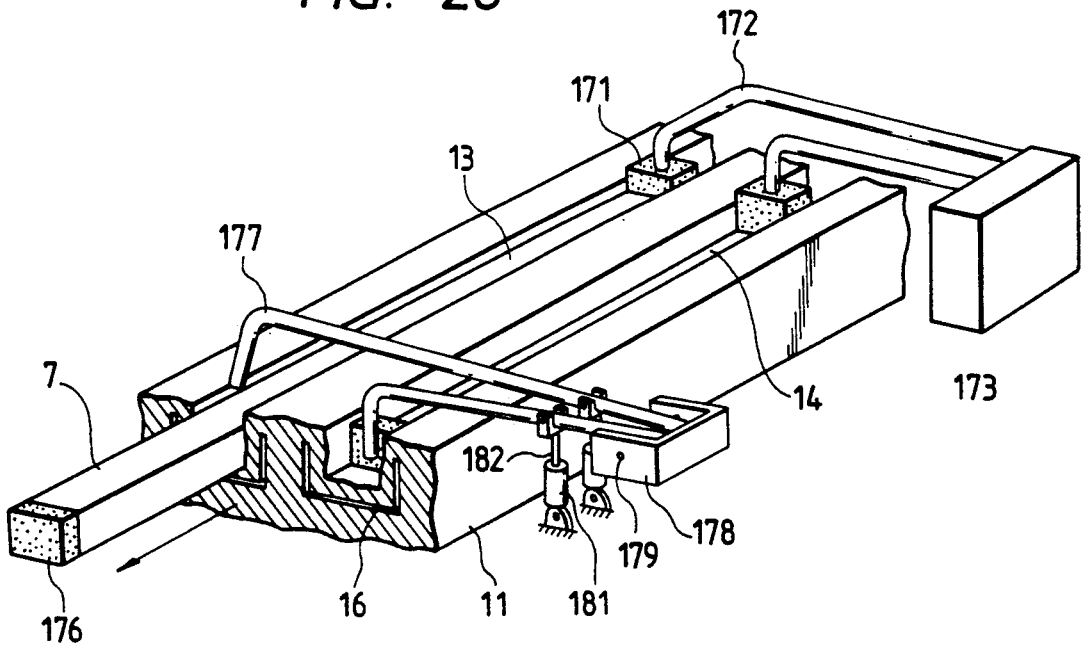
FIG. 26 schematically illustrates the starting condition of continuous casting.

FIG. 26 shows a method of starting multi-strand continuous casting, in which the front dam 176 is released. Cutting off the front dam 176 offers a remarkable advantage as described in the following. In multi-strand casting, the initial pouring spaces in the individual strands are often unequal. Also, the pouring rates of molten steel are often different. Therefore, it is ideal to start casting or withdrawal of each strand independently when the molten steel level in each initial pouring space reaches the desired position. But provision of an independent drive mechanism to each strand pushes up equipment costs. An alternative to this is, therefore, to minimize or eliminate the difference in the time at which the molten steel level reaches the desired position in the individual strands. This alternative is attained by cutting off the front dam 176. Upon pouring, the front dam 176 is individually fastened to a strand. When the molten steel level reaches the desired position in any strand, the front dam 176 therein is released by rotating the annular mold 11. The front dams in the other strands are released likewise as the molten steel level in them reaches the desired position. After the molten steel in the first strand reaches the height of the section to be cast, the front dams 176 in the remaining strands move with the individual molds, thereby compensating the difference in the arrival time of the molten steel level at the desired position.

FIG. 26 shows the annular mold 11 that begins to rotate in the casting direction as the molten steel for the preceding section reaches the predetermined position. The front dam for the following section is fixed in the original position and moves with mold as the molten steel level has not reached the predetermined position. The front dam 176 is released by tilting the support frame 177 by actuating the hydraulic cylinder 181.

Although not always required, the initial pouring space 186 may be formed with a front dam 176 shaped like a box resembling the mold. This initial pouring space can reduce the seizure and slide resistance between the mold wall and molten steel before the rotation of the annular mold is started, thereby permitting a more stable start of casting.

The following paragraphs describe the method of top processing that is applied toward the end of casting.

When the top or tail end of the section is reached, the supply of molten steel is stopped. Therefore, the level of molten steel falls and the desired section profile becomes unobtainable if the rotation of the annular mold is continued even after pouring is discontinued. This can be avoided by suspending the rotation of the annular mold until the tail end of the cast section solidifies. But such suspension is detrimental to the subsequent implementation of direct rolling that constitutes a major feature of this invention. If held in the annular mold over a long period of time, the cast section becomes so cold that rolling becomes no longer possible. Therefore it is essential to process the tail end that solidifies last without stopping the withdrawal of the cast section.

Figure 27:
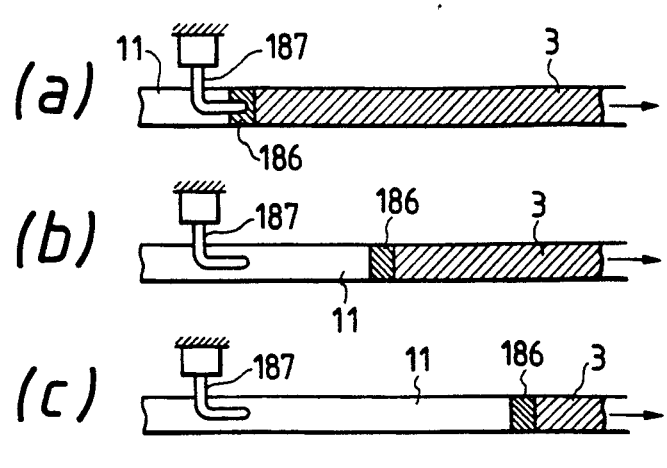
FIG. 27A–C shows how the tail dam is cut off for top processing.

The inventors prevented the drop of the molten steel level in the tail end of the cast section that solidifies last by causing the tail dam 186, which has been fastened away from the annular mold 11, to move immediately after the cast section 3 by releasing the tail dam 186 from the supporting rod 187 the moment the supply of molten steel is stopped (see FIG. 27 (*a*), (*b*) and (*c*)). This method permits raising the casting yield to the maximum limit, thereby lowering the cost of products.

Figure 28:
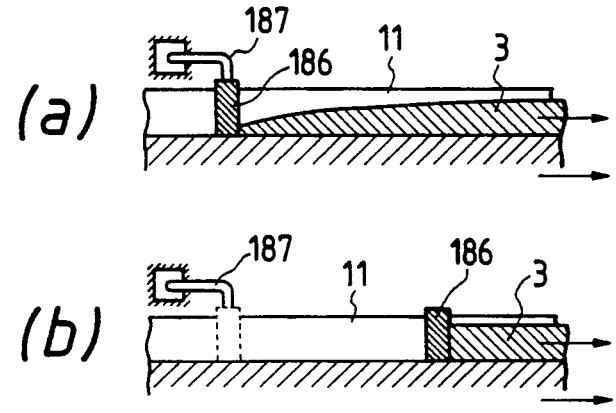
FIG. 28A–B compares the effect of top processing.

FIG. 28 shows the longitudinal cross section of a cast section whose top is processed by releasing the tail dam. The tail dam 186, which does not follow the cast section 3 in (a) of FIG. 28, moves forward immediately after the cast section in (b) of FIG. 28. As is obvious from (b), the molten steel 1 is kept at the desired level down to the tail end of the cast section.

Figure 29:
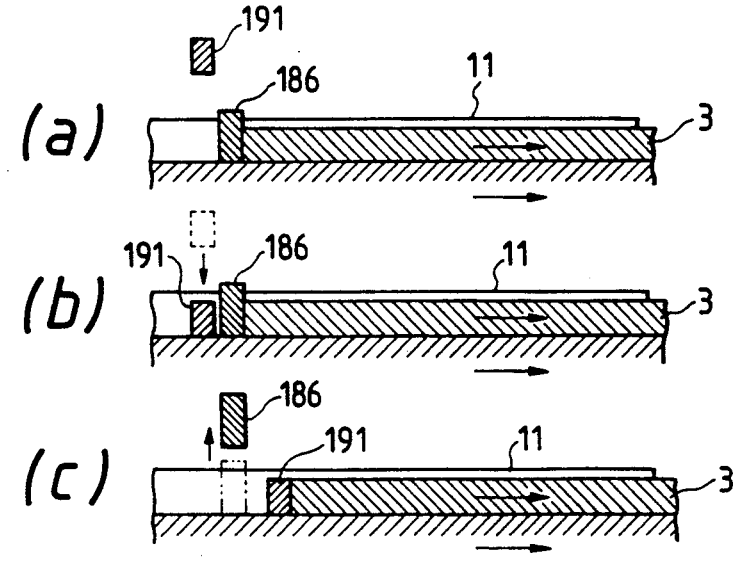
FIG. 29A–C shows how a cooling member is put behind the tail dam during top processing.

FIG. 29 shows the steps of a top processing method that is implemented by placing a cooling member 191 downstream of the tail dam 186. The tail dam 186 was caused to move after the cast section 3 in the method shown in FIG. 27. Here, in contrast, a cooling member 191 is placed downstream of the tail dam 186 and caused to move after the cast section 3 immediately after the suspension of molten steel supply. The cooling member need not be made of any special material but of carbon steel or other common material. The cooling member may be made of the same materials as the tail dam, such as wood and refractory materials. This method necessitates a simple device to permit the replacement of the tail dam 186 and cooling member 191. The tail dam 186 can be made of the same material as the front dam 176, such as refractory materials that are commonly used but are more expensive than iron or other metals. Therefore, even the introduction of an additional replacing means can offer a significant cost advantage.

EXAMPLE 3

Casting and rolling operations performed according to the method of this invention and a conventional method will be described in the following.

Table 5 shows the essential chemical composition of the carbon steel continuously cast in this test.

TABLE 5

Chemical Composition of Carbon Steels (Common to Both Preferred Embodiments and Conventional Methods Tested for Comparison)

| C | Si | Mn | P | S | Al |
|---|---|---|---|---|---|
| 0.30–0.32 | 0.30–0.32 | 0.98–1.020 | 0.010 max | 0.015 max | 0.046–0.050 |

(in percent by weight)

The casting and rolling conditions employed are as follows.

Casting method: Continuous casting with horizontal mold having endless casting groove
No. of strands: 2
Size of cast section: 40 mm square
Radius of mold: 1000 mm
Casting speed: 7.0 m/min.
Superheating: 36° C.
Quantity of continuously cast molten steel: 300 kg
Material of tail dam: Boron nitride (BN)
Rolling equipment: 6-stand continuous hot-rolling mill train with coiling facilities The products continuously cast and directly rolled under the above conditions were evaluated.

The dummy bar and cooling member were made of carbon steel for machine structural use according to JIS G 3102, S10C.

When the dummy bar was not used, front dams made of compacted $Al_2O_3$ fibers and wood were used. The pouring rate of molten steel was controlled by means of a stopper actuated by a hydraulic cylinder.

While it took approximately 6 to 7 seconds to fill each of the initial pouring spaces (40 mm square and about 500 mm long) in the individual strands, the differential in the filling was as much as 2 to 3 seconds, because the pouring rate of molten steel was controlled by means of a stopper. Because of this time difference of 2 seconds, molten steel flew over the casting groove with a probability of approximately 78% when the casting of all strands was started at one time. But no overflow occurred when the front dams were released (by hydraulic means). The effect of the top processing achieved by causing the tail dam or cooling member to move after the tail end of the cast section is described in the following. While the tail dam was made of BN, the cooling member was made of carbon steel (40 mm square and 50 mm long). When the tail dam was caused to follow, the cast section could be hot rolled directly as its temperature remained as high as 1100° C. immediately before the rolling mill train. The product yield throughout the casting and rolling processes was 99.8% when the tail dam was caused to follow, and 99.7% when the cooling member was used. But the yield dropped to 89% when the poured molten steel was continuously withdrawn and hot-rolled without employing the above means.

When the withdrawing was suspended (for about 30 seconds) upon the completion of pouring and resumed after the application of top processing, the temperature in the tail end of the cast section dropped (to approximately 700° C.). The insufficient temperature resulted in the occurrence of cracking during hot rolling, thereby dropping the yield to 85%.

This invention is by no means limited to molten steel, but may be applied to copper and other metals.

What is claimed is:

1. A method of manufacturing strips, bars and wire rods which comprises the steps of:

casting at least one section by providing an annular mold having at least one endless open-top casting groove, and rotatably supported about a vertical axis, continuously supplying molten metal into the at least one endless open-top casting groove, and rotating the mold about said vertical axis;

cooling the molten metal in the casting groove from outside by forcibly cooling the annular mold to facilitate the formation of a cast section in the groove;

carrying out said casting in such a manner that the cast section in the groove has a continuously varying thickness thereacross with a greater thickness on an inner side thereof, formed at the radially innermost side of the casting groove in the annular mold, than on an outer side thereof formed at the radially outermost side of the casting groove; and continuously taking out the cast section from the casting groove at a point where a solidified shell has been formed at least throughout an entire circumferential portion of the molten metal in the casting groove;

depressing the cast section from the top thereof into contact with a surface of the mold defining the bottom of the casting groove with a roll disposed upstream, in a direction of travel of the cast section, of said point from which the cast section is taken out of the casting groove;

pushing the cast section downstream in the direction of travel by rotating said roll; and sliding the cast section upward over a surface located in the casting groove downstream of the roll in the direction of travel of the cast section and inclined at an angle of 5 to 60 degrees relative to the surface defining the bottom of the casting groove.

2. A method of manufacturing strips, bars and wire rods according to claim 1, wherein the step of casting is carried out to satisfy $(\rho-\rho_0)/\rho=\pm 0.3$ where $\rho$=thickness of the cast section at the inner side thereof formed at the radially innermost side of the casting groove in the annular mold/thickness of the cast section at the outer side thereof formed at the radially outermost side of the casting groove, W=width of the cast section, R=mean radius of the annular mold, L=W/R=profile ratio of the cast section, and $\rho_0=1+6L/(6-L)$.

3. A method of manufacturing strips, bars and wire rods according to claim 1, and further comprising compacting the cast section in a vertical direction with one or more rolling members effecting a greater amount of compaction on the inner side of the cast section than on the outer side thereof, once the cast section has been taken out of the mold.

4. A method of manufacturing strips, bars and wire rods according to claim 1, wherein the step of casting comprises pouring molten metal into each of a plurality of casting grooves concentrically disposed on the annular mold so as to simultaneously cast a plurality of sections.

5. A method of manufacturing strips, bars and wire rods according to claim 4, and further comprising subsequently rolling the plurality of simultaneously cast sections simultaneously.

6. A method of manufacturing strips, bars and wire rods according to claim 5, wherein the step of simultaneously rolling the plurality of cast sections comprises simultaneously passing the cast sections through one rolling mill train having rolls of varying diameter which ensure that the rolling speed agrees with the casting speed.

7. A method of manufacturing strips, bars and wire rods according to claim 5, and further comprising first rolling the cast sections separately from one another until the cross-sectional areas thereof become equal, and wherein the step of simultaneously rolling the cast sections comprises subsequently simultaneously rolling the cast sections with a rolling mill train in which a plurality of rolling mill stands are arranged in tandem.

8. A method of manufacturing strips, bars and wire rods according to claim 5, wherein the step of simultaneously rolling the cast sections comprises simultaneously rolling the cast sections with a rolling mill train in which a plurality of rolling mill stands are arranged in tandem, the cast sections of smaller cross-sectional area passing far enough through the rolling mill train without receiving a rolling load until the cross-sectional area of sections of larger cross-sectional area becomes equal thereto.

9. A method of manufacturing strips, bars and wire rods according to claim 5, and further comprising heating the cast section during the casting or rolling step.

10. A method of manufacturing strips, bars and wire rods according to claim 4, wherein the step of casting comprises pouring molten metal into a casting groove having a smaller cross-sectional area than another casting groove located closer to said vertical axis.

11. A method of manufacturing strips, bars and wire rods according to claim 5, wherein the step of casting comprises pouring molten metal into a casting groove having a smaller cross-sectional area than another casting groove located closer to said vertical axis.

12. A method of manufacturing strips, bars and wire rods which comprises the steps of:

simultaneously casting a plurality of sections by providing an annular mold having a plurality of concentrically disposed endless open-top casting grooves, and rotatably supported about a central vertical axis, continuously pouring molten metal into each of the casting grooves, and rotating the mold about said vertical axis, the casting grooves having such cross-sectional areas that the sections will be cast at equal casting rates per unit time of $2\pi NRS$ ($m^3$/min.), where N=the rotating speed of the annular mold (1/min.), R=the distance between the center of the annular mold and the casting groove (m), and S=the cross-sectional area ($m^2$) of the section cast in each casting groove; and cooling the molten metal in each said casting groove from outside by forcibly cooling the annular mold to facilitate the formation of a cast section in each said groove;

continuously taking out the cast section from each said casting groove at a point where a solidified shell has been formed at least throughout an entire circumferential portion of the molten metal in each said casting groove;

depressing each cast section from the top thereof into contact with a surface of the mold defining the bottom of the casting groove with a roll disposed upstream, in a direction of travel of the cast section, of said point from which the cast section is taken out of the casting groove;

pushing each cast section downstream in the direction of travel by rotating said roll; and sliding the cast sections upward over a surface located in the casting grooves downstream of the roll in the direction of travel of the cast sections and inclined at an angle of 5 to 60 degrees relative to the surface defining the bottom of the casting grooves.

13. A method of manufacturing strips, bars and wire rods which comprises the steps of:

simultaneously casting a plurality of sections by providing an annular mold having a plurality of concentrically disposed endless open-top casting grooves, and rotatably supported about a central vertical axis, continuously pouring molten metal into each of the casting grooves at respective locations, and rotating the mold about said vertical axis;

forming an independent initial pouring space in each of the casting grooves by providing a tail dam to prevent a back flow of molten metal and a front dam to prevent an overflow of molten metal upstream and downstream, respectively, of the location at which molten metal is poured into each casting groove, and wherein the step of casting comprises pouring an amount of molten metal into each initial pouring space in a manner so controlled that the molten metal in all of the casting grooves reaches a predetermined level simultaneously;

cooling the molten metal in each said casting groove from outside by forcibly cooling the annular mold to facilitate the formation of a cast section in each said groove;

continuously taking out the cast section from each said casting groove at a point where a solidified shell has been formed at least throughout an entire circumferential portion of the molten metal in each said casting groove;

depressing each cast section from the top thereof into contact with a surface of the mold defining the bottom of the casting groove with a roll disposed upstream, in a direction of travel of the cast section, of said point from which the cast section is taken out of the casting groove;

pushing each cast section downstream in the direction of travel by rotating said roll; and sliding the cast sections upward over a surface located in the casting grooves downstream of the roll in the direction of travel of the cast sections and inclined at an angle of 5 to 60 degrees relative to the surface defining the bottom of the casting grooves.

14. A method of manufacturing strips, bars and wire rods which comprises the steps of:

simultaneously casting a plurality of sections by providing an annular mold having a plurality of concentrically disposed endless open-top casting grooves, and rotatably supported about a central vertical axis, continuously pouring molten metal into each of the casting grooves at respective locations, and rotating the mold about said vertical axis;

forming an independent initial pouring space in each of the casting grooves by providing a tail dam to prevent a back flow of molten metal and a front dam to prevent an overflow of molten metal in each respective said casting groove upstream and downstream, respectively, of the location at which molten metal is poured into the respective casting groove, and wherein the step of casting comprises pouring molten metal into each initial pouring space;

cooling the molten metal in each said casting groove from outside by forcibly cooling the annular mold to facilitate the formation of a cast section in the groove;

continuously taking out the cast section from each said casting groove at a point where a solidified shell has been formed at least throughout an entire circumferential portion of the molten metal in each said casting groove;

depressing each cast section from the top thereof into contact with a surface of the mold defining the bottom of the casting groove with a roll disposed upstream, in a direction of travel of the cast section, of said point from which the cast section is taken out of the casting groove;

pushing each cast section downstream in the direction of travel by rotating said roll; and sliding the cast sections upward over a surface located in the casting grooves downstream of the roll in the direction of travel of the cast sections and inclined at an angle of 5 to 60 degrees relative to the surface defining the bottom of the casting grooves;

wherein the step of continuously taking out the cast section from the casting groove includes sliding the front dam from its respective casting groove once the molten metal in the initial pouring space has reached a level corresponding to a predetermined height of the section to be cast in the respective casting groove, whereby the cast sections are taken out of the mold in an order in which the molten metal having formed the sections reached said level in the pouring space.

15. A method of manufacturing strips, bars and wire rods which comprises the steps of:

simultaneously casting a plurality of sections by providing an annular mold having a plurality of concentrically disposed endless open-top casting grooves, and rotatably supported about a central vertical axis, continuously pouring molten metal into each of the casting grooves at respective locations, and rotating the mold about said vertical axis;

providing a tail dam in each said casting groove upstream of the location at which molten metal is poured into each said casting groove to prevent a back flow of molten metal, holding the tail dam as the molten metal is poured into each said casting groove, respectively, and subsequently releasing the tail dam upon the completion of casting and causing the tail dam to move downstream behind the cast section, thereby preventing a drop of the level of the molten metal and an occurrence of shrinkage cavities in a tail end of the cast section;

cooling the molten metal in each said casting groove from outside by forcibly cooling the annular mold to facilitate the formation of a cast section in each said groove;

continuously taking out the cast section from each said casting groove at a point where a solidified shell has been formed at least throughout an entire circumferential portion of the molten metal in each said casting groove;

depressing each cast section from the top thereof into contact with a surface of the mold defining the bottom of the casting groove with a roll disposed upstream, in a direction of travel of the cast section, of said point from which the cast section is taken out of the casting groove;

pushing each cast section downstream in the direction of travel by rotating said roll; and sliding the cast sections upward over a surface located in the casting grooves downstream of the roll in the direction of travel of the cast sections and inclined at an angle of 5 to 60 degrees relative to the surface defining the bottom of the casting grooves.

16. A method of manufacturing strips, bars and wire rods which comprises the steps of:

simultaneously casting a plurality of sections by providing an annular mold having a plurality of concentrically disposed endless open-top casting grooves, and rotatably supported about a central vertical axis, continuously pouring molten metal into each of the casting grooves at respective locations, and rotating the mold about said vertical axis;

providing a tail dam in each said casting groove upstream of the location at which molten metal is poured into each said casting groove to prevent a back flow of molten metal, holding the tail dam as the molten metal is poured into each said casting groove, respectively, placing a cooling member behind the tail dam upon the completion of casting, subsequently removing the tail dam and causing the cooling member to move downstream behind the cast section, thereby preventing a drop in the level of the molten metal and an occurrence of shrinkage cavities in a tail end of the cast section;

cooling the molten metal in each said casting groove from outside by forcibly cooling the annular mold to facilitate the formation of a cast section in each said groove;

continuously taking out each cast section from the casting groove at a point where a solidified shell has been formed at least throughout an entire circumferential portion of the molten metal in each said casting groove;

depressing each cast section from the top thereof into contact with a surface of the mold defining the bottom of the casting groove with a roll disposed upstream, in a direction of travel of the cast section, of said point from which the cast section is taken out of the casting groove;

pushing each cast section downstream in the direction of travel by rotating said roll; and sliding the cast sections upward over a surface located in the casting grooves downstream of the roll in the direction of travel of the cast sections and inclined at an angle of 5 to 60 degrees relative to the surface defining the bottom of the casting grooves.

* * * * *